US010724420B2

(12) United States Patent
Momosaki et al.

(10) Patent No.: US 10,724,420 B2
(45) Date of Patent: Jul. 28, 2020

(54) EXHAUST DEVICE FOR UTILITY VEHICLE

(71) Applicant: KAWASAKI JUKOGYO KABUSHIKI KAISHA, Kobe-shi, Hyogo (JP)

(72) Inventors: Makoto Momosaki, Kakogawa (JP); Jun Takagi, Himeji (JP); Koutarou Hanabusa, Kobe (JP)

(73) Assignee: KAWASAKI JUKOGYO KABUSHIKI KAISHA (JP)

( * ) Notice: Subject to any disclaimer, the term of this patent is extended or adjusted under 35 U.S.C. 154(b) by 4 days.

(21) Appl. No.: 16/189,056

(22) Filed: Nov. 13, 2018

(65) Prior Publication Data

US 2020/0149458 A1 May 14, 2020

(51) Int. Cl.

| | |
|---|---|
| ***F01N 13/14*** | (2010.01) |
| ***F01N 13/18*** | (2010.01) |
| ***F01N 13/10*** | (2010.01) |

(52) U.S. Cl.

CPC ..... *F01N 13/14* (2013.01); *F01N 13/107* (2013.01); *F01N 13/1805* (2013.01); *F01N 2590/00* (2013.01)

(58) Field of Classification Search

CPC .... F01N 13/14; F01N 13/1805; F01N 13/107; F01N 2590/00

See application file for complete search history.

(56) References Cited

U.S. PATENT DOCUMENTS

| | | | | |
|---|---|---|---|---|
| 2005/0099001 | A1* | 5/2005 | Cassel | F01N 13/1805 285/23 |
| 2013/0233431 | A1* | 9/2013 | Tanaka | F16L 9/19 138/114 |
| 2016/0332536 | A1* | 11/2016 | Weber | B60P 1/04 |

* cited by examiner

*Primary Examiner* — Brandon D Lee

(57) ABSTRACT

An exhaust device for an engine is disposed beneath a loading platform at a position rearwardly of a seat of a utility vehicle. A plurality of exhaust pipes extend rearwardly from a front surface of an engine main body by way of one lateral side of the engine main body. The plurality of the exhaust pipes are collected by a single collecting tube. An exhaust conduit extends from the collecting tube in a direction rearwardly of the engine. A muffler is disposed in a rear portion of the vehicle and fluid connected with a downstream end of the exhaust conduit. The exhaust pipes, the collecting tube and the exhaust conduit are covered by a covering. The covering is fitted to the exhaust pipes and the exhaust conduit to thereby suppress a heat conduction from the exhaust pipes, the collecting tube and the exhaust conduit.

12 Claims, 14 Drawing Sheets

EXHAUST DEVICE FOR UTILITY VEHICLE

BACKGROUND OF THE INVENTION

Field of the Invention

The present invention relates to an exhaust device disposed beneath a loading platform at a site rearwardly of the seat in a utility vehicle.

The utility vehicle is an all-terrain vehicle which is also called a four wheeled buggy car and is capable of being driven regardless of geographic conditions. In such a vehicle, an engine is generally disposed beneath a loading platform at a site rearwardly of the vehicle seat. Exhaust gases emitted from the engine are guided through an exhaust pipe to a muffler at the rear of the vehicle body and are then discharged to the outside.

An exhaust system including the exhaust pipe is exposed to high temperatures and, therefore, peripheral components such as, for example, seats and loading platform or the like have to be protected with protecting coverings. When the use of the protective coverings is made to protect the peripheral components such as, for example, seats and a loading platform or the like, the coverings are extensively needed.

SUMMARY OF THE INVENTION

The present invention is intended to provide an exhaust device for use in a utility vehicle, which device is effective, with a simplified structure, to protect peripheral component parts from heats evolved in the exhaust system.

In order to accomplish the foregoing object of the present invention, an exhaust device for a utility vehicle according to a first structure of the present invention is disposed beneath a loading platform at a site rearwardly of a seat and comprises: a plurality of exhaust pipes extending from a front surface of an engine main body in a direction rearwardly of the vehicle by way of one lateral side of the engine main body; a single collecting tube configured to collect a plurality of the exhaust pipes together; an exhaust conduit extending from the collecting tube in a direction rearwardly of the engine; a muffler disposed in a rear portion of a vehicle body and fluid connected with a downstream of the exhaust conduit; a front covering configured to cover an entire periphery of the plurality of the exhaust pipes; and a rear covering configured to cover the collecting tube and the exhaust conduit from at least outer lateral side and above, in which the front covering are so divided into a first covering piece and a second covering piece, the first and second covering pieces being connected together while respective upstream end portions and respective downstream end portions sandwich the exhaust pipes.

It is to be noted that the term "utility vehicle" referred to hereinbefore and hereinafter is intended to mean a vehicle which can be driven on and under various geographic conditions including, for example, muddy lands, sandy beaches and snowy roads and which includes an all-terrain vehicle that is also called a four wheeled buggy car. The utility vehicle is used in various applications, for example, leisure and works.

According to the above described construction, since the exhaust pipes, the collecting tube and the exhaust conduit, all cooperating to form an exhaust system, are covered by the front covering and the rear covering, peripheral component parts can be protected from heat emanating from the exhaust system. Also, the provision of the front covering and the rear covering in the exhaust system is effective to consummate the structure on the side of heat emitting components. Accordingly, with a simplified structure, the peripheral component parts can be effectively protected from heat generated from the exhaust system. Also, any possible contact of an intermediate portion between upstream end portions and downstream end portions of both of the first and second covering pieces with the exhaust pipe of elevated temperature can be avoided. Thereby, the degree of freedom of design in selection of the material for the covering piece can be increased.

In the practice of the first construction of the present invention, the rear covering may cover regions laterally and above the collecting tube and the exhaust conduit, excluding beneath thereof. According to this construction, since no peripheral component parts to be heat insulated exist beneath the collecting tube and the exhaust conduit, no covering may be needed on the lower side. Therefore, the structure of the rear covering can be simplified.

In such case, the rear covering may be fitted to the collecting tube and the exhaust conduit through a bracket in a condition with a gap existing between the rear covering and each of the collecting tube and the exhaust conduit. According to this construction, any possible contact of the rear covering with the collecting tube and the exhaust conduit, which are heated to elevated temperatures, can be avoided. Accordingly, the degree of freedom of design in selection of the material or the other for the rear covering can be increased.

In such case, the rear covering may be connected with the collecting tube and the exhaust conduit, by means of clamping from outside of the rear covering, at a portion corresponding to the bracket. According to this construction, the rear covering does not contact the collecting tube and the exhaust conduit, which are heated to elevated temperature, other than a region of clamping. Accordingly, the degree of freedom of design in selection of the material or the other for the rear covering can be increased.

In such case, the use may be made of a plurality of the brackets, in which the bracket disposed at a rear end portion is fixed to the rear covering. Since in general an oxygen sensor is arranged in the rear portion of the exhaust conduit, there is no space for installation of the brackets. According to this construction, since the bracket disposed in the rear end portion is fixed to the rear covering, a rear portion of the exhaust conduit can be supported by a bracket at a rear end portion.

In such case, the remaining brackets may be fixed to the collecting tube or the exhaust conduit. According to this construction, the necessity is eliminated to fix the bracket to the rear covering that is of a complicated shape. Therefore, the productivity of the exhaust device can be increased.

In the practice of the first construction of the present invention, the front covering and the rear covering may be formed integrally, and the integrally formed exhaust covering may be so divided into a first exhaust covering piece and a second exhaust covering piece, in which case the first and second exhaust covering pieces may be connected together while respective upstream end portions and respective downstream end portions of those first and second covering pieces sandwich the exhaust pipes, the collecting tube and the exhaust conduit. According to this construction, a middle of the exhaust covering does not contact the exhaust pipes, the collecting tube nor the exhaust conduit. Accordingly, the degree of freedom of design in selection of the material or the other for the rear covering can be increased.

In such case, a mating surface between the first exhaust covering piece and the second exhaust covering piece may form a single plane. According to this construction, manufacture and assemblage of the front covering and the rear covering can be facilitated.

In the practice of the first construction of the present invention, the use may be made of a first muffler covering piece and a second muffler covering piece, which are so divided in a direction circumferentially of the muffler, so as to cover a peripheral surface of the muffler, in which case the first and second muffler pieces may be fixed to nuts, secured to the muffler, by means of screw bodies. According to this construction, the peripheral component parts can be protected from heat emanating from the muffler that forms a part of the exhaust system. Also, since the both muffler pieces are fixed to the nuts, which are fixed to the muffler, by means of the screw bodies, the structure is simple.

A utility vehicle of the present invention may comprise: the exhaust device designed in accordance with the present invention; and electric component parts including a battery, which may be arranged above the exhaust pipe. The utility vehicle often makes use of electric component parts in an upward region so that no muddy water may fall thereon during the drive on a rough road. According to this construction the electric component parts can be protected from heat.

A utility vehicle of the present invention may comprise: the exhaust device designed in accordance with the present invention; a continuously variable transmission being disposed on the other side surface of the engine; and an exhaust duct for the continuously variable transmission, which duct may be disposed above the exhaust pipe. According to this construction, the exhaust duct for the continuously variable transmission can be protected from heat generated from the exhaust system.

A utility vehicle of the present invention may comprise: the exhaust device designed in accordance with the present invention; and an air intake chamber for accumulating an intake air, which air intake chamber may be disposed between the engine main body and the muffler and above the exhaust pipe. According to this construction, the air intake chamber can be protected from heat generated from the exhaust system.

An exhaust device for a utility vehicle designed in accordance with the second construction of the present invention is disposed beneath a loading platform at a position rearwardly of a seat, and comprises: a plurality of exhaust pipes extending rearwardly from a front surface of an engine main body by way of one lateral side of the engine main body; a single collecting tube configured to collect a plurality of the exhaust pipes together; an exhaust conduit extending from the collecting tube in a direction rearwardly of the engine; a muffler disposed in a rear portion of a vehicle body and fluid connected with a downstream end of the exhaust conduit; and an exhaust covering configured to cover entire peripheries of a plurality of the exhaust pipes, the collecting tube and the exhaust conduit. The exhaust covering referred to above are so divided into a first exhaust covering piece and a second exhaust covering piece. The first exhaust covering piece is removably fitted via a bracket to at least one of the exhaust pipes, the collecting tube and the exhaust conduits. The second exhaust covering piece is removably connected with the first exhaust covering piece.

According to the above construction, since the exhaust pipe, the collecting tube and the exhaust conduit, all cooperating to define the exhaust system, is covered by the exhaust covering, the peripheral components can be protected from heat generated from the exhaust system. Also, the provision of the exhaust covering in the exhaust system is effective to consummate the structure on the side of heat emitting components. Accordingly, with a simplified structure, the peripheral component parts can be effectively protected from heat generated from the exhaust system. Also, the first exhaust covering piece is fitted to the exhaust system through the bracket and is not in direct contact with the exhaust system. In addition, the second exhaust covering piece is connected with the first exhaust covering piece and is not in contact with the exhaust system. Therefore, the degree of freedom of design in selection of the material for the exhaust covering can be increased.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF PREFERRED EMBODIMENTS

Hereinafter preferred embodiments of the present invention will be described in detail with particular reference to the accompanying drawings. In describing the present embodiment, however, the terms "left and right" used hereinabove and hereinafter are to be understood as relative terms descriptive of positions and/or direction as viewed from a driver maneuvering a vehicle.

Figure 1:
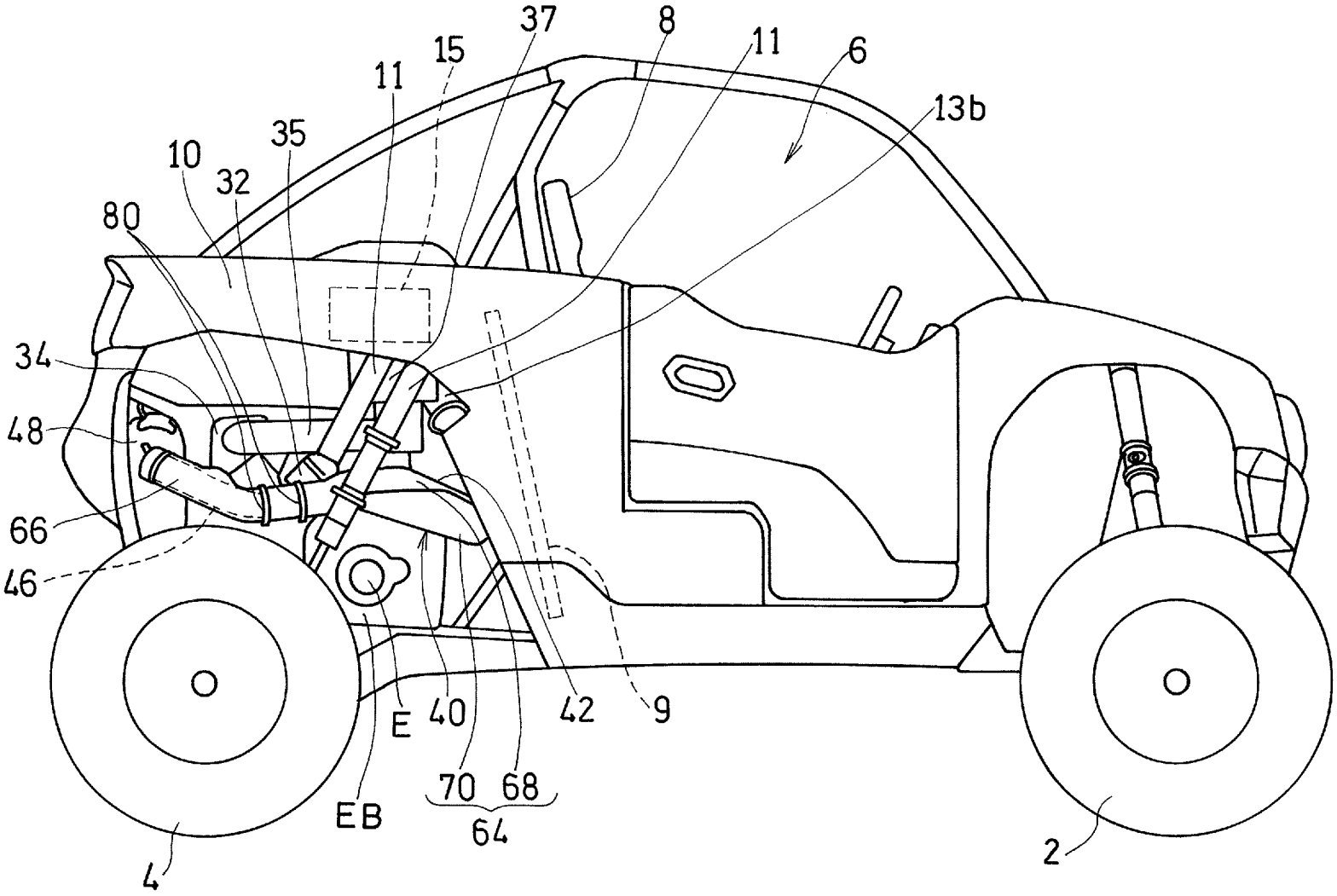
FIG. 1 is a side view showing a utility vehicle equipped with an exhaust device for an engine designed according to a first preferred embodiment of the present invention.

In particular, FIG. 1 illustrates a side view of a utility vehicle equipped with an exhaust device for use in an engine which is designed in accordance with a first preferred embodiment of the present invention. It is to be noted that the term "utility vehicle" referred to hereinbefore and hereinafter is intended to mean an all-terrain vehicle, which is also called a four wheeled buggy and which can be driven on any road regardless of various geographic conditions including, for example, muddy lands, sandy beaches and snowy roads. The utility vehicle of this kind is used in various applications, for example, leisure and works.

Figure 2:
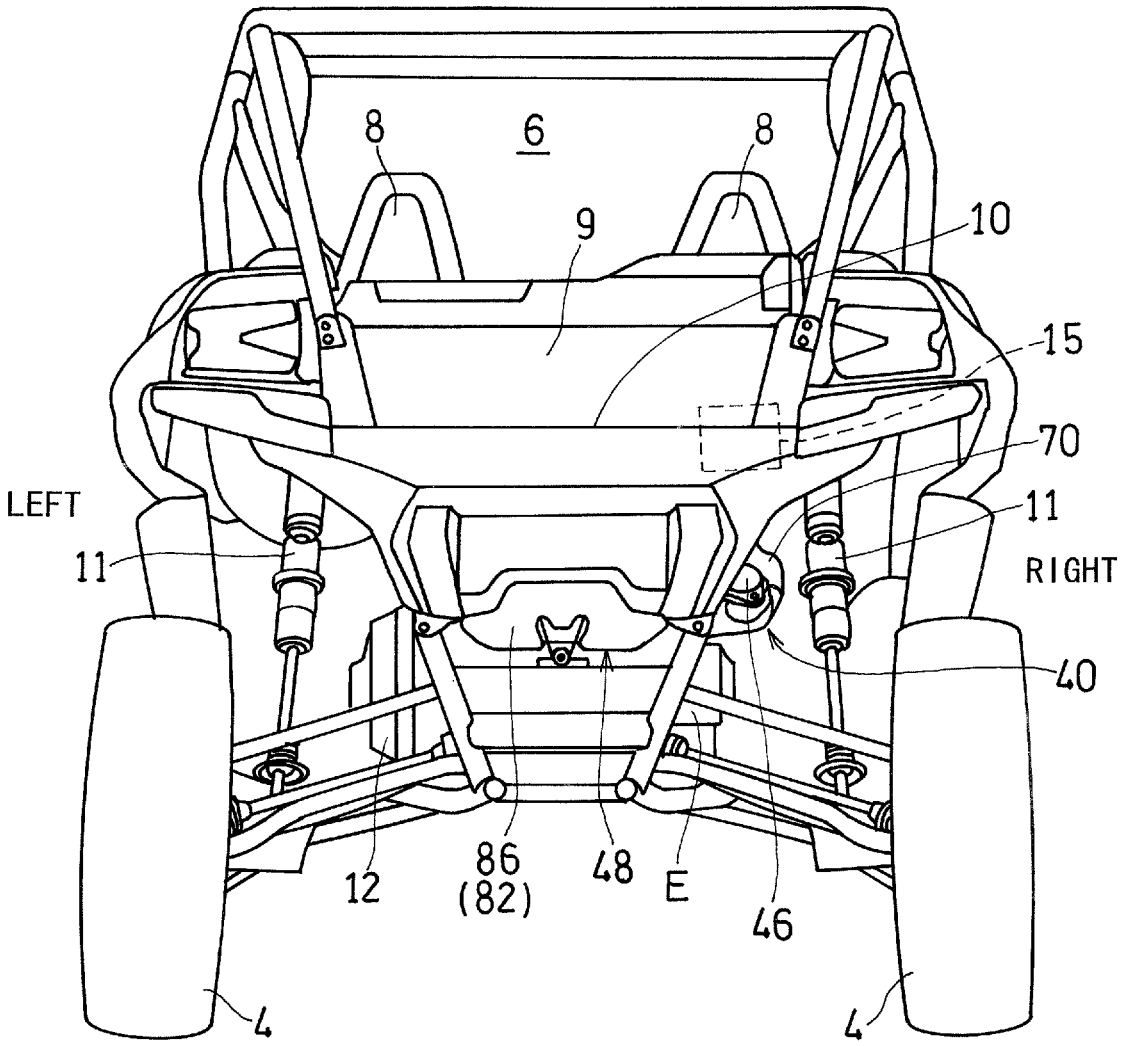
FIG. 2 is a rear view showing the utility vehicle.
Figure 6:
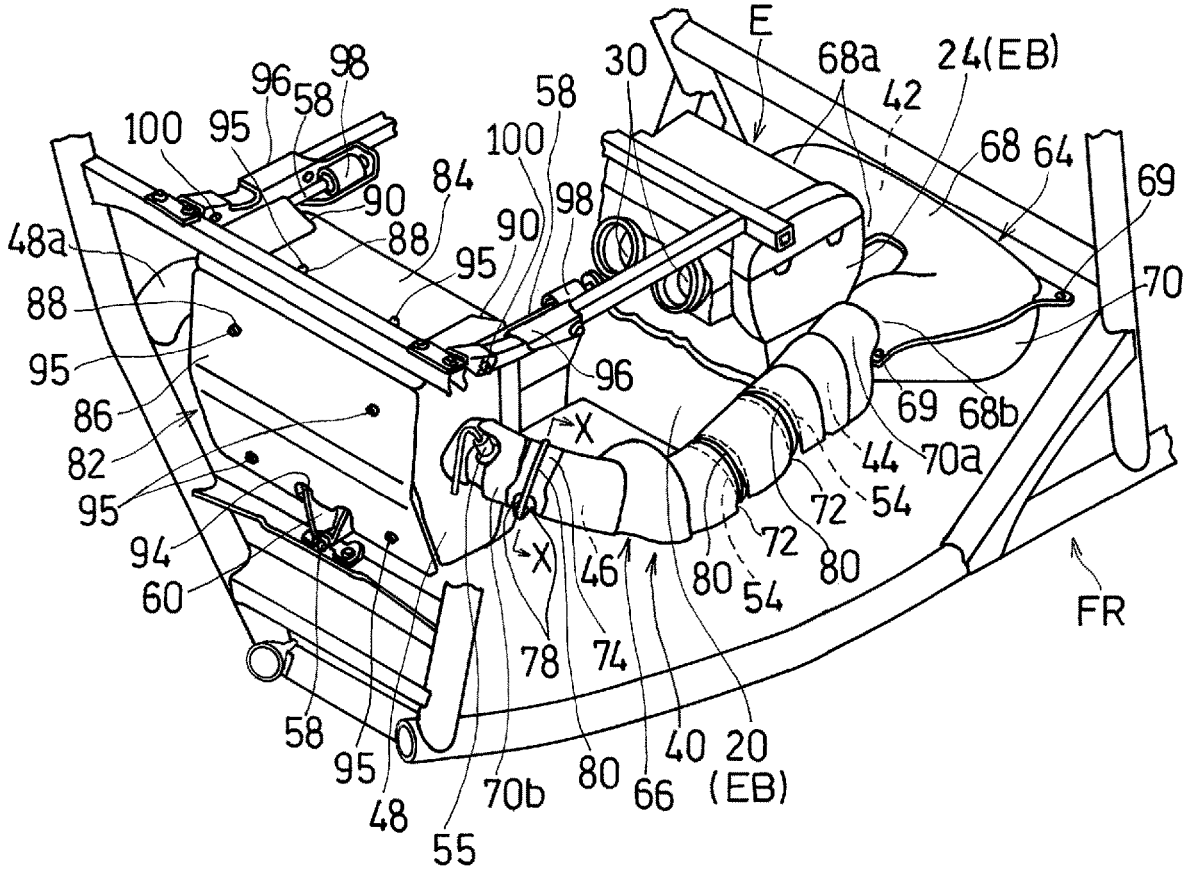
FIG. 6 is a perspective view showing the exhaust device as viewed downwardly from a point diagonally rearwardly of such exhaust device.

The utility vehicle according to the first preferred embodiment is provided with a driver's cabin 6 positioned between front wheels 2 and rear wheels 4. The driver's cabin 6 includes a seat 8 for a driver to sit within the driver's cabin 6. A loading platform 10 is provided at a site rearwardly of the driver's cabin 6 and above the rear wheels 4. The loading platform 10 employed in the practice of this embodiment is made of resin material. An engine E, which is a drive source, is disposed rearwardly of the seat 8 and beneath the loading platform 10. The engine E is supported by a vehicle frame FR (FIG. 6). The seat 8 and the engine E are partitioned from each other by a partition plate 9. The partition plate 9 employed in the practice of this embodiment is made of resin material. As shown in FIG. 2, the engine E is disposed between left and right rear wheels 4. Specifically, the engine E is disposed between rear suspensions 11 and 11 for the left and right rear wheels 4. A battery 15, which is one of electric components, is disposed above the engine E.

The vehicle employed in the practice of this embodiment is a four-wheel drive car. Specifically, the rotating power generated by the engine E is transmitted to the rear wheels 2 (FIG. 1) through a continuously variable transmission 12 disposed on a right side of the engine E and by way of a gear box 14 shown in FIG. 3, and is also transmitted to the rear wheels 2 (FIG. 1) through a drive shaft 16. As shown in FIG. 4, an induction duct 13*a* and an exhaust duct 13*b* are connected with the continuously variable transmission 12. The induction duct 13*a* supplies therethrough a cooling air into the continuously variable transmission 12, and then, air which has been used for cooling is led out from the exhaust duct 13*b*. Each of the induction duct 13*a* and the exhaust duct 13*b*, both employed in the practice of this embodiment, is made of resin material.

Figure 3:
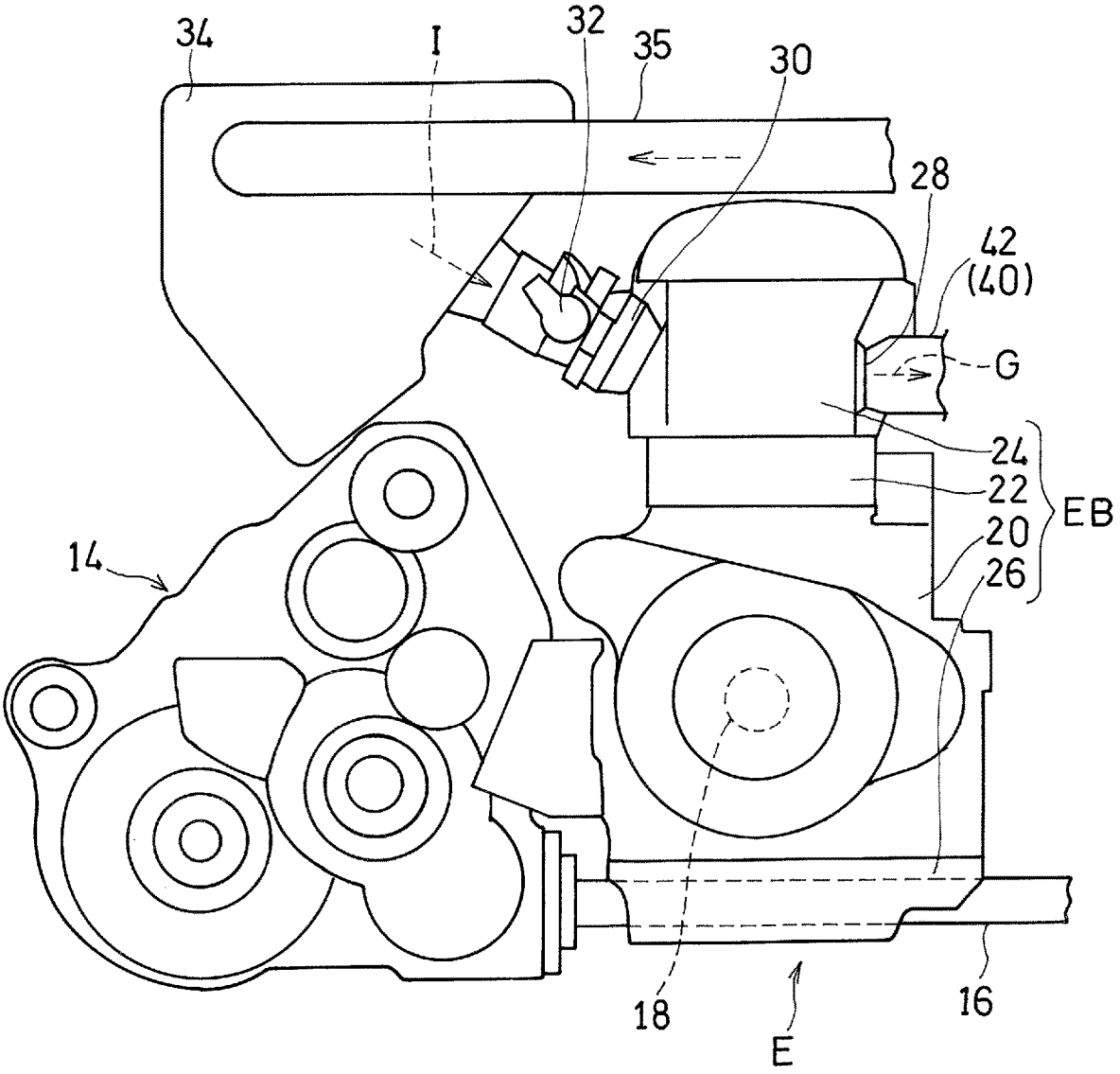
FIG. 3 is a side view showing the engine.
Figure 4:
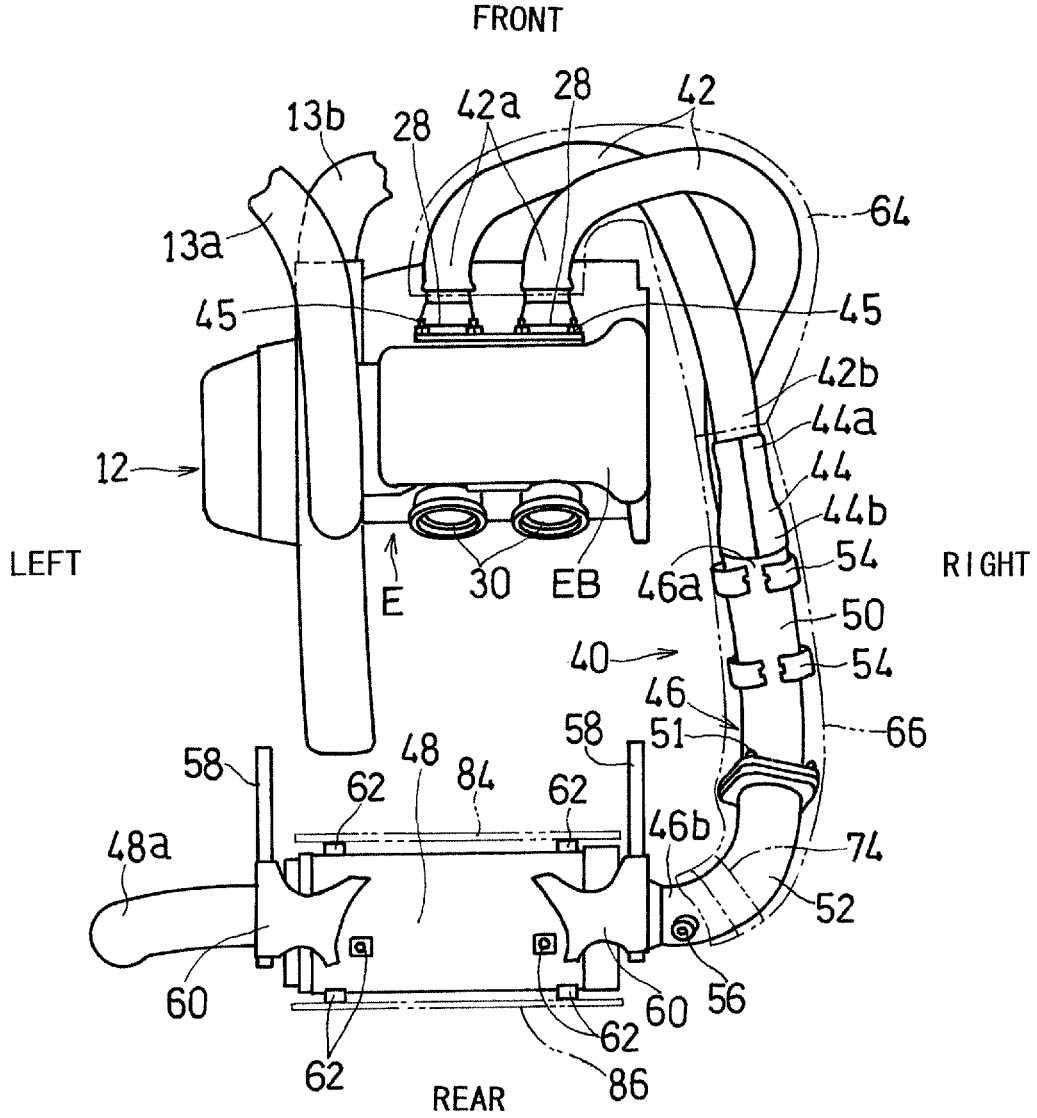
FIG. 4 is a top view showing the exhaust device.

The engine E shown in FIG. 3 includes a crankshaft 18 extending in a direction parallel to a vehicle widthwise direction, a crankcase 20 for supporting the crankshaft 18, a cylinder 22 protruding upwardly from the crankcase 20, a cylinder head 24 on the top of the cylinder 22, and an oil pan 26 fitted to a bottom portion of the crankcase 20. The crankcase 20, the cylinder 22, the cylinder head 24 and the oil pan 26 cooperate with each other to constitute an engine man body EB.

An exhaust port 28 is formed in a front surface of the cylinder head 24, and an intake port 30 is foiined in a rear surface of the cylinder head 24. Each of the exhaust port 28 and the intake port 30 is employed two in number. The two exhaust ports 28 are juxtaposed relative to each other in a direction parallel to the vehicle widthwise direction. The two intake ports 30 are juxtaposed relative to each other in a direction parallel to the vehicle widthwise direction.

A throttle body 32 is fluid connected with each of the intake ports 30. This throttle body 32 is operable to adjust the amount of air to be supplied to the engine E and also to generate an air-fuel mixture by injecting fuel into an intake air. The throttle body 32 has an inlet fluid connected with an outlet of an air intake chamber 34. The air intake chamber 34 serves to accumulate the intake air I to be supplied to the engine E. The air intake chamber 34 employed in the practice of the embodiment now under discussion is made of resin material. The air intake chamber 34 is disposed above the gear box 14 at a site rearwardly of the cylinder head 24. To this air intake chamber 34, the intake air I is supplied from an air cleaner 37 through an air intake tube 35.

Figure 5:
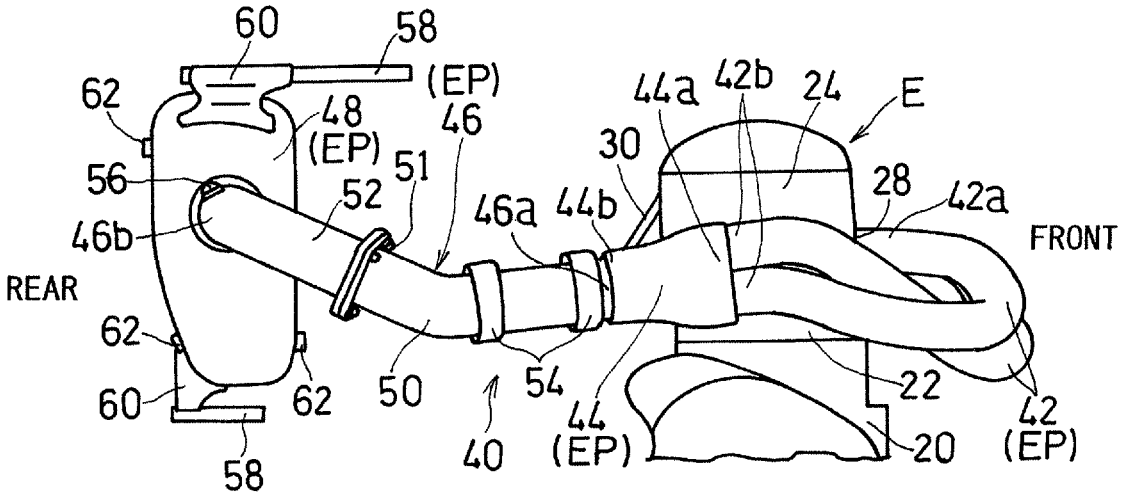
FIG. 5 is a side view showing the exhaust device.

The exhaust port 28 is fluid connected with an exhaust device 40. FIG. 4 illustrates a top view of the exhaust device 40, and FIG. 5 illustrates a side view of the exhaust device 40. In the description that follows, the terms "upstream" and "downstream" both associated with the exhaust system are intended to mean upstream and downstream, respectively, with respect to the direction flow of exhaust gases G from the engine E, respectively. The exhaust device 40 includes two exhaust pipes 42 and 42 fluid connected with respective exhaust ports 28, a single collecting tube 44 having the two exhaust pipes 42 and 42 collected at a site downstream of the exhaust pipe 42, an exhaust conduit 46 fluid connected with an downstream end of the collecting tube 44, and a muffler 48 fluid connected with a downstream end of the exhaust conduit 46. The exhaust pipe 42, the collecting tube 44, the exhaust conduit 46 and the muffler 48 cooperate with each other to constitute an exhaust passage EP of the engine E. Each of the exhaust pipe 42, the collecting tube 44, the exhaust conduit 46 and the muffler 48 is made of, for example, stainless steel.

Each of the exhaust pipes 42 has an upstream end 42*a* fluid connected with the exhaust port 28. Specifically, each of the exhaust pipes 42 is removably fitted to the exhaust port 28. The exhaust pipe 42 is, after having protruded from the front surface of the engine main body EB, curved 180° and then, extends along a right side of the engine main body EB in a direction rearwardly of the vehicle. In the practice of the embodiment now under discussion, a portion of the exhaust pipe 42 and a portion of the collecting tube 44 are, when viewed from side as shown in FIG. 5, overlapped with the cylinder 22 and the cylinder head 24.

The respective downstream ends 42*b* of the exhaust pipes 42 are fluid connected with an upstream end 44*a* of the collecting tube 44. Due to the collecting duct 44, two exhaust passages are joined together to provide a single exhaust passage. In the practice of the embodiment now under discussion, the exhaust pipes 42 and the collecting tube 44 are fluid connected with each other by means of welding.

The collecting tube 44 has a downstream end 44*b* fluid connected with the upstream end 46*a* of the exhaust conduit 46. In the practice of the embodiment now under discussion, the collecting tube 44 and the exhaust conduit 46 are fluid connected with each other by means of welding. As shown in FIG. 4, the exhaust conduit 46 is, after having extended rearwardly from the collecting tube 44, curved inwardly of the vehicle widthwise direction (towards a left side) at an area rearwardly of the engine E, and is then fluid connected with the muffler 48 at the downstream end 46*b* thereof. In the practice of the embodiment now under discussion, the exhaust conduit 46 and the muffler 48 are fluid connected with each other by means of welding.

In consideration of the assemblability and the mounting capability, the exhaust conduit 46 employed in the practice of the embodiment now under discussion is constituted by two tubes, that is, an upstream side tube 50 and a downstream side tube 52. The upstream side tube 50 constitutes a tube portion that extends rearwardly from the collecting tube 40, whereas the downstream side tube 52 constitutes a tube portion that is curved inwardly of the vehicle widthwise direction at the site rearwardly of the engine E. The upstream side tube 50 and the downstream side tube 52 are removably connected with each other by means of a plurality of bolts 51. It is, however, to be noted that the exhaust conduit 46 may be constituted by a single tube.

A first bracket 54 is fitted to the upstream side tube 50 of the exhaust conduit 46. The first bracket 54 employed in the practice of the embodiment now under discussion is constituted by two members, each formed of a steel sheet, by folding such steel sheet so as to represent a shape similar to the shape of "C". Each of the first bracket 54 has opposite end portions connected with an outer peripheral surface of the exhaust conduit 46 by means of welding. Except for the weld joint, the outer peripheral surface of the exhaust conduit 46 and the first bracket 54 are spaced from each other to define a space. It is, however, to be noted that the shape of the first bracket 54 may not be necessarily limited to that described above. In the practice of the embodiment now under discussion, the first bracket 54 is employed two in number. Specifically, one of the two first brackets 54 is fitted in the vicinity of the upstream end 46*a* of the exhaust conduit 46, and the other of the two first brackets 54 is fitted at a position spaced from such one of the first brackets 54 in a direction rearwardly of the vehicle. It is, however, to be noted that the number of the first brackets 54 used may not be necessarily limited to that described above.

The downstream side tube 52 of the exhaust conduit 46 is provided with a mounting seat 56. Specifically, the mounting seat 56 is provided in the vicinity of the downstream end 46*b* of the exhaust conduit 46. In other words, the mounting seat 56 is disposed at a site immediately preceding the muffler 48 (i.e., immediately upstream of the muffler 48 with respect to the direction of flow of the exhaust gases). The mounting seat 56 employed in the practice of the embodiment now under discussion is in the form of a cylindrical boss protruding outwardly from the outer peripheral surface of the exhaust conduit 46. To this mounting seat 56, an oxygen sensor 55 shown in FIG. 6 is fitted. The oxygen sensor 55 serves to detect the concentration of oxygen contained in the exhaust gases G.

As shown in FIG. 1, the muffler 48 is disposed in a rear end portion of the vehicle body. The muffler 48 employed in the practice of the embodiment now under discussion is of a substantially rectangular parallelepiped shape in which dimensions in the vehicle widthwise direction and in the upward and downward direction are large, but the dimension in the forward and rearward direction is small. The muffler 48 has an expansion chamber (not shown) defined inside thereof, and the exhaust gases G introduced thereinto is silenced. As shown in FIG. 4, the muffler 48 has a right side wall to which the downstream end 46*b* of the exhaust conduit 46 is fluid connected, and also has a left side wall to which an exit tube 48*a* is fluid connected. The exhaust gases G, having been expanded and silenced within the muffler 48, are discharged to the outside through the exit tube 48*a*.

The muffler 48 has an outer peripheral surface that is provided with fitting bars 58 through which the muffler 48 can be fitted to the vehicle body. The fitting bars 58 employed in the practice of the embodiment now under discussion are each in the form of a round rod of steel material and fitted to the muffler 48 so as to extend in a direction parallel to the forward and rearward direction. The fitting bars 58 are fitted to the muffler 48 through respective mounting brackets 60. Specifically, each of the fitting bars 58 is jointed to the respective mounting bracket 60 by means of welding, and the mounting bracket 60 is in turn jointed to the outer peripheral surface of the muffler 48 by means of welding. In the practice of the embodiment now under discussion, the fitting bars 58 are provided in left and right opposite end portions of an upper end portion of the muffler 48 and also in a vehicle widthwise direction intermediate portion of a lower end portion of the muffler 48. It is, however, to be noted that the number of the fitting bars 58 and the site at which the fitting bars 58 are fitted are not necessarily limited to those described above and shown.

The muffler 48 has an outer surface to which a welded nut 62 is fitted. The welded nut 62 protrudes outwardly from the outer surface of the muffler 48. In the practice of the embodiment now under discussion, two welded nuts 62 are provided on the upper surface of the muffler 48; four welded nuts 62 are provided on the rear surface of the muffler 48; and two welded nuts 62 are provided on the front surface of the muffler 48, thus totaling to 8 welded nuts 62 used for the muffler 48. However, the number of the welded nuts 62 is not necessarily limited to that described above.

As shown in FIG. 1, the partition plate 9 is disposed forwardly of the exhaust pipe 42, and the loading platform 10 is disposed above the exhaust pipe 42. Also, the air intake chamber 34 is disposed between the engine main body EB and the muffler 48 and above the exhaust conduit 46. The exhaust duct 13*b* of the continuously variable transmission 12 shown in FIG. 4 is disposed above the exhaust pipe 42. Also, the battery 15 is disposed above the engine main body EB and the exhaust pipe 42. In an off-road vehicle such as the utility vehicle referred to the present embodiments, electric components including the battery 15 are disposed at a high level location so that during, for example, drive on a rough road, muddy water may not fall on the electric components. The right side rear suspension 11 is disposed on an outer side (right side) of the exhaust conduit 46.

The exhaust passage EP for the flow of the exhaust gases G is apt to be heated to a high temperature. Since, for the purpose of weight reduction, the partition plate 9, the loading platform 10, the air intake chamber 34 and the exhaust duct 13*b* are each made of resin material, they have a heat resistance that is relatively low as compared with that of component parts which are made of, for example, stainless steel. The electric component parts including the battery 15, when heated to high temperatures, may possibly fail to operate properly. Considering that the rear suspensions 11 contain grease, the operation of the rear suspensions 11 may become instable when the rear suspensions 11 is heated to the high temperature. Accordingly, countermeasures against heat are needed in those peripheral component parts.

As shown in FIG. 6, the exhaust device 40 includes a front covering 64 to cover the two exhaust pipes 42 and a rear covering 66 to cover the collecting tube 44 and the exhaust conduit 46. The front covering 64 covers an entire periphery of the two exhaust pipes 42. On the other hand, the rear covering 66 covers the collecting tube 44 and the exhaust conduit 46 from lateral outside and above, excluding a region below them. Specifically, the rear covering 66 employed in the practice of the embodiment now under discussion covers the entire periphery of the collecting tube 44 and the exhaust conduit 46 except for regions therebelow. The front covering 64 and the rear covering 66, both employed in the practice of the embodiment now under discussion, are each made of stainless steel.

The front covering 64 is of two components structure including a first covering piece 68 on an upper side and a second covering piece 70 on a lower side, the first and second covering pieces 68 and 70 being connected together by means of a plurality of bolts 69.

Figure 7:
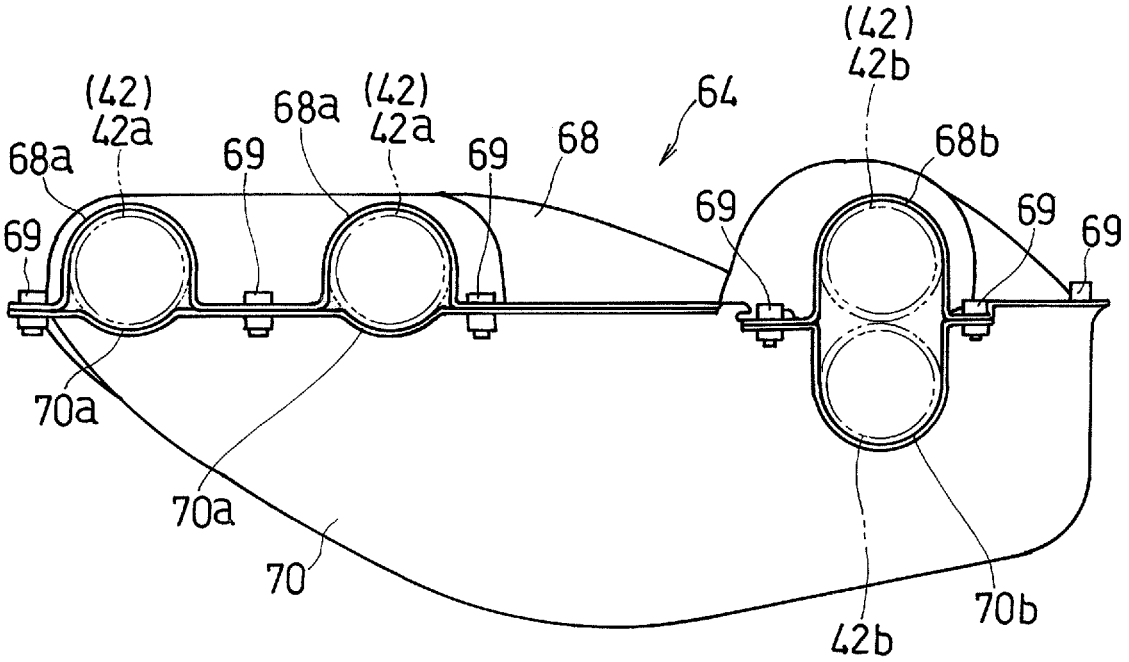
FIG. 7 is a rear view showing a front covering used in the exhaust device, as viewed from a point rearwardly of such exhaust device.

FIG. 7 illustrates a rear view of the front covering 64 as viewed from rear. In a condition in which an upstream end portion 68*a* of the first covering piece 68 and an upstream end portion 70*a* of the second covering 70 cooperate with each other to sandwich vicinities of respective upstream ends 42*a* of the exhaust pipes 42, the upstream end portion 68*a* of the first covering piece 68 and the upstream end portion 70*a* of the second covering 70 are connected together by means of bolts 69. Similarly, in a condition in which a downstream end portion 68*b* of the first covering piece 68 and a downstream end portion 70*b* of the second covering piece 70 cooperate with each other to sandwich vicinities of respective downstream ends 42*b* of the exhaust pipes 42, the downstream end portion 68*b* of the first covering piece 68 and the downstream end portion 70*b* of the second covering piece 70 are connected together by means of the bolts 69.

In the practice of the embodiment now under discussion, excluding the respective upstream end portions 68*a* and 70*a* and the respective downstream end portions 68*b* and 70*b*, a space is formed between the front covering 64 and the outer peripheral surface of the exhaust pipe 42. In other words, the exhaust pipe 42 and the front covering 64 do not contact with each other, except for the upstream end portions 68*a* and 70*a* and the downstream end portions 68*b* and 70*b*.

The rear covering 66 shown in FIG. 6 is formed by applying a folding technique to a sheet metal, and the transverse sectional shape thereof represents a shape similar to the figure "U" that opens downwardly, that is, an inverted U-shaped configuration. At a position of the rear covering 66 which position corresponds to each of the first bracket 54 of the exhaust conduit 46, a first cutout 72 is formed. This first cutout 72 is a cutout that extends upwardly from a lower end of the rear covering 66 and is formed at each of two lower ends of inverted U-shaped configuration.

Figure 8:
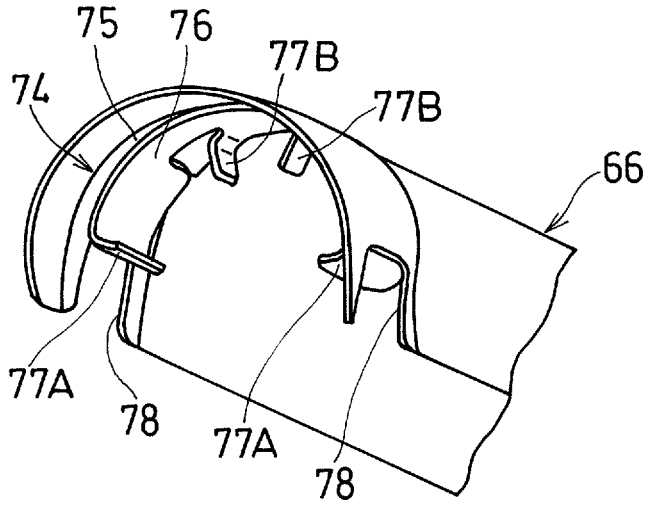
FIG. 8 is a perspective view showing a downstream end portion of a rear covering used in the exhaust device, as viewed rearwardly from a point diagonally downwardly of such exhaust device.

A second bracket 74 is formed, as shown in FIG. 8, in the downstream end portion of the rear covering 66. Specifically, the lower end portion of the rear covering 66 is processed to have an increased diameter to thereby form a recessed portion 75 therein. This recessed portion 75 has its inner surface to which a reinforcement member 76 is fixed. The reinforcement member 76 is made of plate material, and is so curved as to follow the curvature of the inner surface of the recessed portion 75 so as to extend in the circumferential direction. The reinforcement member 76 is welded to the inner surface of the recessed portion 75. Circumferentially opposite end portions of the reinforcement member 76 are bend radially inwardly to define respective first legs 77A. Also, a portion of the reinforcement member 76 that is intermediate with respect to the circumferential direction of such reinforcement member 76 is bent radially inwardly to define circumferentially spaced second legs 77B. In the embodiment now under discussion, the second legs 77B are spaced a distance from each other in the circumferential direction. It is, however, to be noted that the number of the second legs 77B may not be necessarily limited to that described above and shown. The reinforcement member 76 and the first and second legs 77A and 77B cooperate with each other to constitute the second bracket 74.

At a position of the rear covering 66, which position corresponds to the second bracket 74, a second cutout 78 is formed. The second cutout 78 is also a cutout that extends upwardly from a lower end of the rear covering 66 and is formed at each of circumferentially spaced lower ends thereof while each representing an inverted U-shaped configuration.

In the embodiment now under discussion, the three brackets 54, 54 and 74 are employed; the second bracket 74 in the rear end portion is fixed to the rear covering 66; and the remaining two first brackets 54 and 54 are fixed to the exhaust conduit 46.

The rear covering 66 shown in FIG. 6 are fitted to the collecting tube 44 and the exhaust conduit 46 through the first and second brackets 54, 54 and 74 with a gap existing between the rear covering 66 and each of the collecting tube 44 and the exhaust conduit 46. Specifically, the rear covering 66 is connected, at respective portions corresponding to the brackets 54 and 74, with the collecting tube 44 and the exhaust conduit 46 by means of a clamp 80 from the outside of the rear covering 66. The clamp 80 employed in the practice of the embodiment now under discussion is an annular fastening member of a kind used to fasten the rear covering 66 to the exhaust conduit 46 from the outer periphery. The clamp 80 is so disposed as to be engageable with the first and second cutouts 72 and 78.

Figure 9:
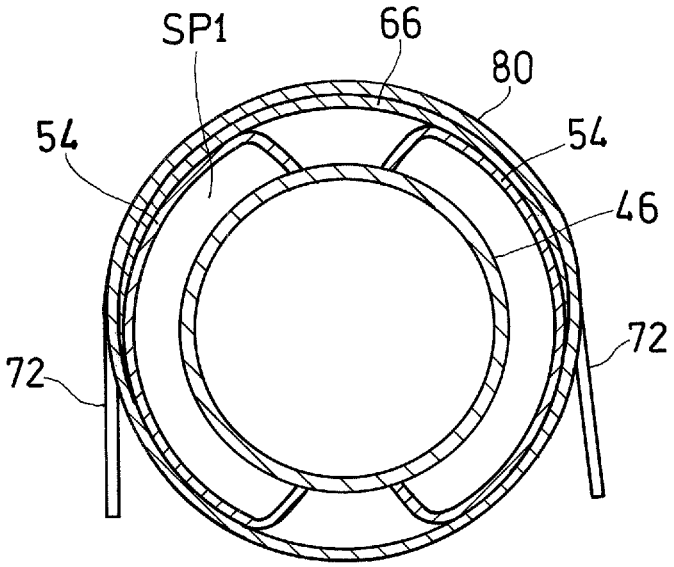
FIG. 9 is a sectional view showing a support structure for the rear covering in the exhaust device.

As shown in FIG. 9, at sites of connection made by the two front side first brackets 54, the rear covering 66 is hung over the first bracket 54. In this condition, the rear covering 66 is fastened externally by the clamp 80. Accordingly, a front portion of the rear covering 66 is fitted to the exhaust conduit 46. At this time, the rear covering 66 is brought into contact with the first bracket 54, but the rear covering 66 does not contact the exhaust conduit 46. A gap space SP1 is formed between the rear covering 66 and the exhaust conduit 46.

Figure 10:
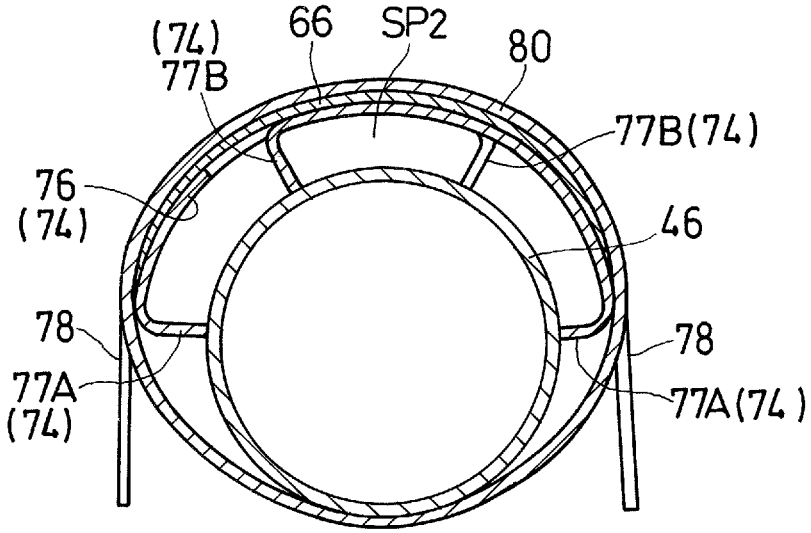
FIG. 10 is a cross sectional view taken along the line X-X in FIG. 6.

As shown in FIG. 10, at a site of connection made by the rear side second bracket 74, the second bracket 74 provided in the rear covering 66 is brought into contact with the outer peripheral surface of the exhaust conduit 46. In this condition, the rear covering 66 is fastened externally by means of the clamp 80. Accordingly, the rear portion of the rear covering 66 is fitted to the exhaust conduit 46. At this time, the rear covering 66 is brought into contact with the second bracket 74, but the rear covering 66 does not directly contact the exhaust conduit 46. A gap space SP2 is formed between the rear covering 66 and the exhaust conduit 46. From the foregoing, the rear covering 66 is fitted to the collecting tube 44 and the exhaust conduit 46 in a condition with the gap existing between the rear covering 66 and each of the collecting tube 44 and the exhaust conduit 46.

The exhaust device 40 according to the embodiment now under discussion further includes a muffler covering 82 for covering upper, front and rear surfaces of the muffler 48 shown in FIG. 6. The muffler covering 82 employed in the practice of the embodiment now under discussion includes a first muffler covering piece 84 and a second muffler covering piece 86, which pieces 84 and 86 are so divided in a circumferential direction (about the vehicle widthwise direction axis) into those two components. The first muffler covering piece 84 covers the front and upper surfaces of the muffler 48, whereas the second muffler covering piece 86 covers the rear surface of the muffler 48. The first and second muffler covering pieces 84 and 86 employed in the practice of the embodiment now under discussion are each made by folding a stainless steel plate.

Figure 11:
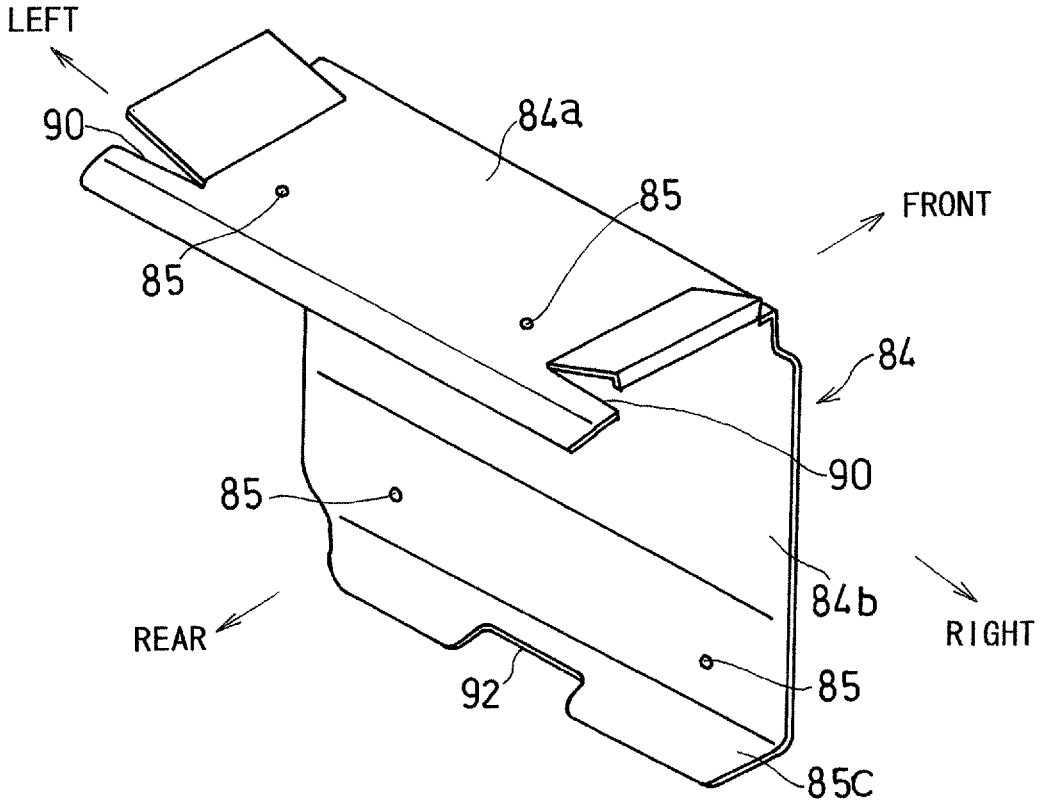
FIG. 11 is a perspective view showing a first muffler covering used in the exhaust device.

As shown in FIG. 11, the first muffler covering piece 84 includes an upper surface covering portion 84*a* for covering the upper surface of the muffler 48 and a front surface covering portion 84*b* for covering the front surface of the muffler 48. The first muffler covering piece 84 is formed with a first bolt insertion hole 85. In the practice of the embodiment now under discussion, the first bolt insertion hole 85 is employed two in number in the upper surface covering portion 84*a* and, also, two in number in the front surface covering portion 84*b*. It is, however, to be noted that the number and the place of the first bolt insertion hole 85 may not be necessarily limited to those described above and shown.

The upper surface covering portion 84*a* of the first muffler covering piece 84 has its left and right opposite end portions each formed with a first recessed portion 90. The first recessed portion 90 is in the form of a cutout formed by bending the corresponding end portion of the upper surface covering portion 84*a* in a direction upwardly. The front surface covering portion 84*b* of the first muffler covering piece 84 has its lower end portion that is formed with a second recessed portion 92. The second recessed portion 92 is in the form of a cutout with a portion of the lower end portion of the front surface covering portion 84*b* having been cut out.

Figure 12:
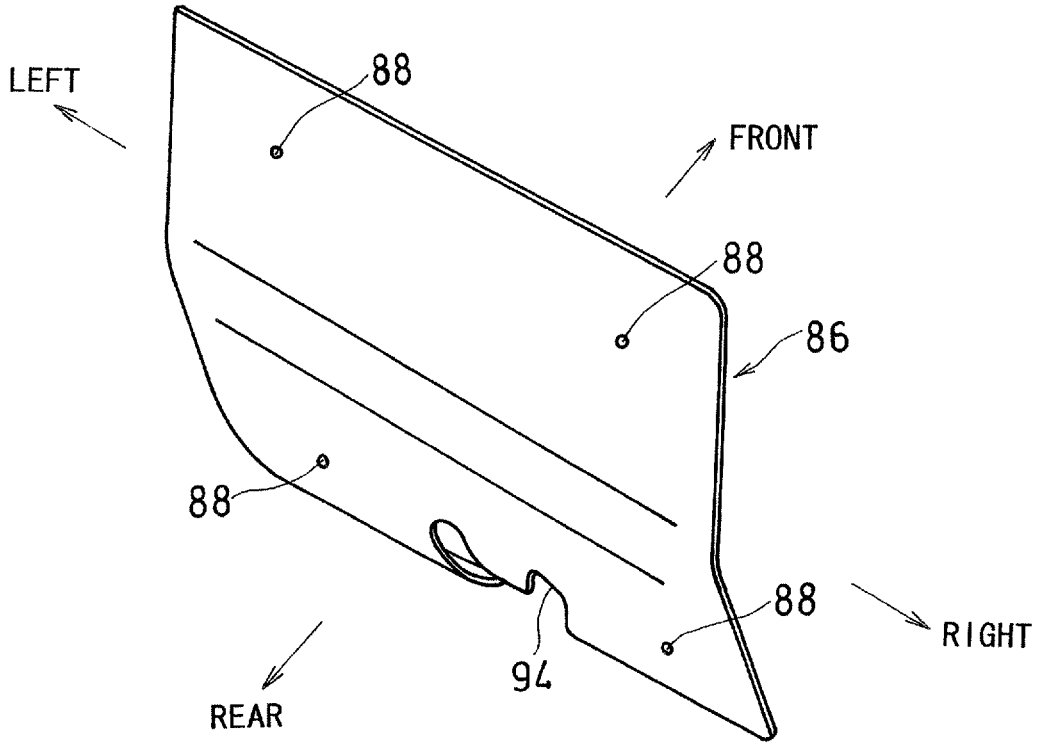
FIG. 12 is a perspective view showing a second muffler covering used in the exhaust device.

As shown in FIG. 12, the second muffler covering piece 86 is formed to a shape following the rear surface of the muffler 40. This second muffler covering piece 86 is formed with a second bolt insertion hole 88. In the practice of the embodiment now under discussion, the second bolt insertion hole 88 is provided four in number. It is, however, to be noted that the number of the second bolt insertion holes 88 employed may not be necessarily limited to that shown and described. The second muffler covering piece 86 has its lower end portion formed with a third recessed portion 94. The third recessed portion 94 is a cutout with a portion of the lower end portion of the second muffler covering piece 86 having been cut out.

In the following description, a fitting structure for fitting the first and second muffler covering pieces 84 and 86 onto the muffler 48 will be described. As shown in FIG. 6, the first and second muffler covering piece 84 and 86 are fitted to the muffler 48 by means of screw bodies 95 such as, for example, bolts. Specifically, the screw bodies 95 are inserted through the second bolt insertion holes 88 in the second muffler covering piece 86 from rear, and are then fastened with the welded nuts 62 on the muffler 48 shown in FIG. 4.

At this time, the second muffler covering piece 86 is brought into contact with only the welded nut 62, and does not contact the outer surface of the muffler 48. In this way, the second muffler covering piece 86 is, in a condition with a gap formed between the second muffler covering piece 86 and the muffler 48, fitted to the muffler 48. Also, since the third recessed portion 94 (FIG. 12) is provided in the lower end portion of the second muffler covering piece 86, the fitting bracket 60 (FIG. 5) for the fitting bar 58 at the lower end portion of the muffler 48 does not interfere with the second muffler covering piece 86.

The screw bodies 95 are inserted into the respective first bolt insertion holes 85 from above and front, and are then fastened with the associated welded nuts 62 in the muffler 48. At this time, the first muffler covering piece 84 is brought into contact with only the welded nut 62 and does not contact the outer surface of the muffler 48 after all. Thus, the first muffler covering piece 84 is, with a gap provided between the first muffler covering piece 84 and the muffler 48, fitted to the muffler 48. Also, since the first recessed portions 90 (FIG. 11) are provided in the upper end portion of the first muffler covering piece 84, the fitting brackets 60 for the upper end portion of the muffler 48 do not interfere with the first muffler covering piece 84.

An installation structure for fitting the exhaust device 40 onto the vehicle body will now be described. As shown in FIG. 4, the upstream end 42*a* of the exhaust pipe 42 is fitted to the exhaust port 28 of the engine E by means of the bolts 45. The exhaust pipe 42 is fixed rigidly to the engine E. Accordingly, a front portion of the exhaust device 40 is supported by the vehicle body through the engine E.

As shown in FIG. 6, the muffler 48 is supported by the vehicle frame FR through the three fitting bars 58. Specifically, the vehicle frame FR has cylindrical rubber dampers 98 fitted thereto though respective fitting brackets 96, and the fitting bars 58 are inserted into respective interiors of the rubber dampers 98. In other words, the muffler 48 is elastically mounted on the vehicle frame FR. In the practice of the embodiment now under discussion, the fitting brackets 96 are fitted to the vehicle frame FR by means of respective fastening members 100 such as, for example, bolts, and the rubber dampers 98 are fixed to the fitting brackets 96 by adhesion. Accordingly, a rear portion of the exhaust device 40 is supported by the vehicle body.

In the embodiment now under discussion, with the fitting bars 58 having been inserted respectively into the interiors of the rubber dampers 98, the rear portion of the exhaust device 40 is supported by the vehicle body. Accordingly, in the event of thermal expansion of the exhaust device 40, each of the fitting bars 58 displaces within the interior of the corresponding rubber damper 98 in forward or rearward direction. Thereby, the thermal expansion of the exhaust device 40 can be absorbed.

Figure 13:
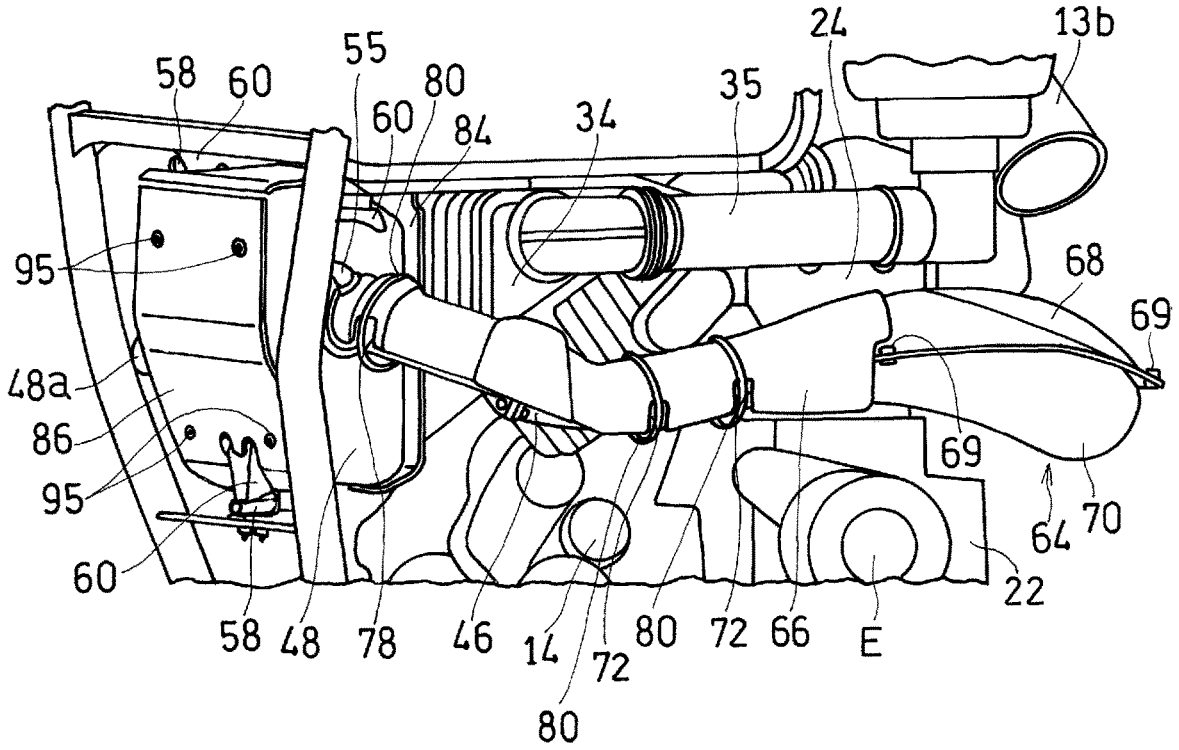
FIG. 13 is a perspective view showing a rear portion of the utility vehicle.

In the construction according to the embodiment now under discussion, the exhaust pipe 42 shown in FIG. 4 is covered by the front covering 64 and, at the same time, the collecting tube 44 and the exhaust conduit 46 are covered by the rear covering 66. Respective shapes of the coverings 64 and 66 are specifically shown in FIG. 13. Accordingly, the peripheral parts can be protected from heat evolved in the exhaust device 40. More specifically, as shown in FIG. 1, the partition plate 9 made of resin material is disposed forwardly of the exhaust pipe 42, and the exhaust duct 13*b*, made of resin material, and the battery 15, which is one of the electric parts, are disposed above the exhaust pipe 42. Also, the air intake chamber 34, made of resin material, is disposed above the exhaust conduit 46, and the rear suspension 11 is disposed laterally outwardly of the collecting tube 44. In addition, the loading platform 10, made of resin material, is disposed above the exhaust pipe 42, the collecting tube 44 and the exhaust conduit 46. Those components 9, 10, 11, 13*b* and 34 are protected from heats evolved in the exhaust device 40.

The front covering 64 and the rear covering 66 are provided, not on the side adjacent to the peripheral component parts to be protected, but on the side adjacent to the exhaust device 40. Accordingly, the heat insulating structure can be consummated on the side adjacent to the exhaust device 40. In view of this, with a simplified structure, the peripheral component parts can be protected from the heat generated from the exhaust device 40. Since no peripheral component to be protected is located beneath the collecting tube 44 and the exhaust conduit 46, regions on the side beneath the collecting tube 44 and the exhaust conduit 46 need not be covered. Therefore, the structure of the rear covering 66 can be simplified.

The front covering 64 includes the first covering piece 68 and the second covering piece 70 which are so divided into those two components, and those first and second covering pieces 68 and 70 are so connected with each other while the upstream end portions 68*a* and 70*a* thereof and the downstream end portions 68*b* and 70*b* thereof sandwich the exhaust pipe 42 therebetween. Accordingly, it is possible to avoid any possible contact of intermediate portions of the first and second coverings 68 and 70 between the upstream end portions 68*a* and 70*a* and the downstream end portions 68*b* and 70*b* with the exhaust pipe 42 then heated to the elevated temperature. In view of this, the degree of freedom of design including selection of material for each of the first and second covering pieces 68 and 70 can be increased.

As shown in FIGS. 9 and 10, the rear covering 66 is fitted to the exhaust conduit 46 by means of the first and second brackets 54 and 74 while the gaps SP1 and SP2 exist between the rear covering 66 and each of the collecting tube 44 and the exhaust conduit 46. Specifically, the rear covering 66 is connected at respective portions, corresponding to the first and second brackets 54 and 74, with the exhaust conduit 46 by means of the clamp 80 from exteriorly of the rear covering 66. Accordingly, it is possible to avoid any possible contact of the rear covering 66 with the collecting tube 4 and the exhaust conduit 46, then both heated to high temperatures, in regions other than the regions in which they are clamped by the clamps 80. As a result thereof, the degree of freedom of design in selection of material for the rear covering 66 can be increased.

As shown in FIG. 6, since the oxygen sensor 55 is fitted to the downstream end portion 46*b* of the exhaust conduit 46, there is no space where any bracket is provided. According to the above discussed construction, the second bracket 74 at a rear end portion, of a plurality of the first and second brackets 54 and 74, is fixed to the rear covering 66. Accordingly, the rear portion of the exhaust conduit 46 can be supported by the second bracket 74.

As shown in FIG. 4, the remaining first brackets 54 and 54 are fixed to the exhaust conduit 46. Accordingly, there is no need to provide the rear covering 66 of a complicated shape with any bracket. As a result thereof, the productivity of the exhaust device 40 can be increased.

As shown in FIG. 6, regions forwardly of, rearwardly of and above the muffler 48 are covered by the muffler covering 82. Accordingly, the peripheral component parts can be protected from heat evolved in the muffler 48. Specifically, the air intake chamber 34 made of resin material is disposed forwardly of the muffler 48, and the loading platform 10 made of resin material is arranged above the muffler 48. Those loading platform 10 and air intake chamber 34 are protected from heat evolved in the muffler 48. Also, since the muffler 48 are disposed at the rear end of the vehicle body, it is possible to prevent heat from radiating in a direction rearwardly of the vehicle body during the parking.

The muffler covering 82 includes the first muffler covering piece 84 and the second muffler covering piece 86, which are so divided into those components in a circumferential direction of the muffler 48, and the first and second muffler covering piece 84 and 86 are fixed, by the screw bodies 95, to the welded nuts 62 that are fixed to the muffler 48. Accordingly, with a simplified structure, the muffler covering pieces 84 and 86 can be fitted to the muffler 48. At this time, the first and second muffler covering pieces 84 and 86 are brought into contact with only the welded nuts 62 and do not contact the muffler 48 then heated to high temperatures. Accordingly, the degree of freedom of design in selection of the material for the first and second muffler covering pieces 84 and 86 can be increased.

Figure 14:
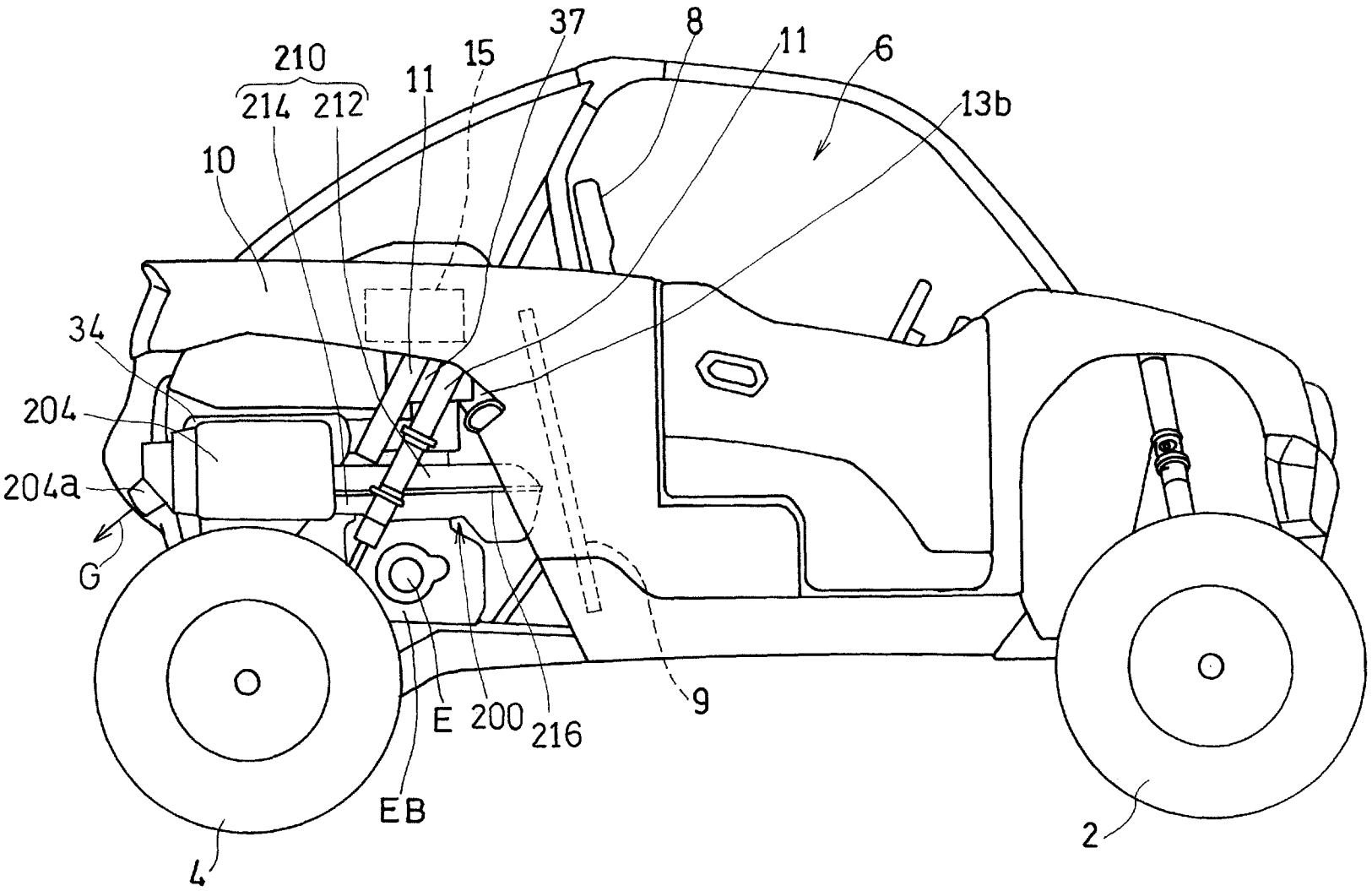
FIG. 14 is a side view showing the utility vehicle equipped with the exhaust device for an engine designed according to a second preferred embodiment of the present invention.
Figure 15:
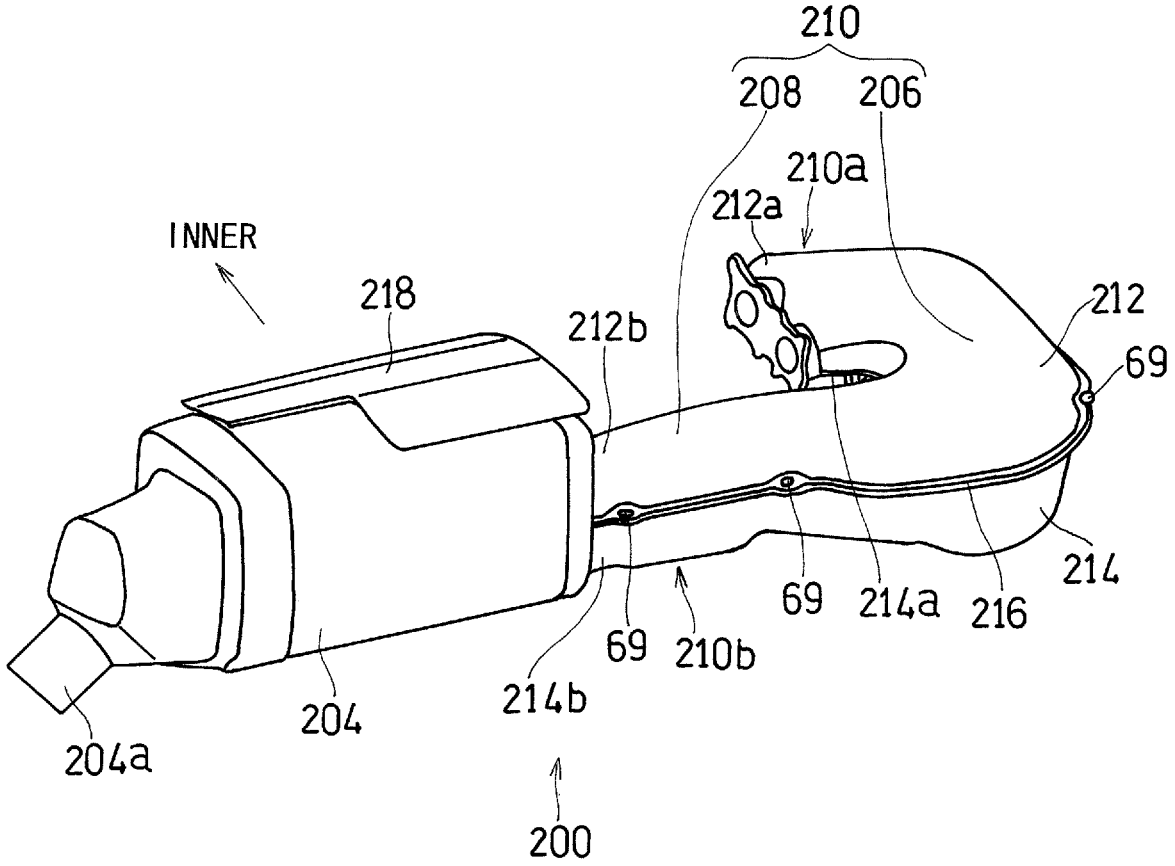
FIG. 15 is a perspective view showing the exhaust device.
Figure 16:
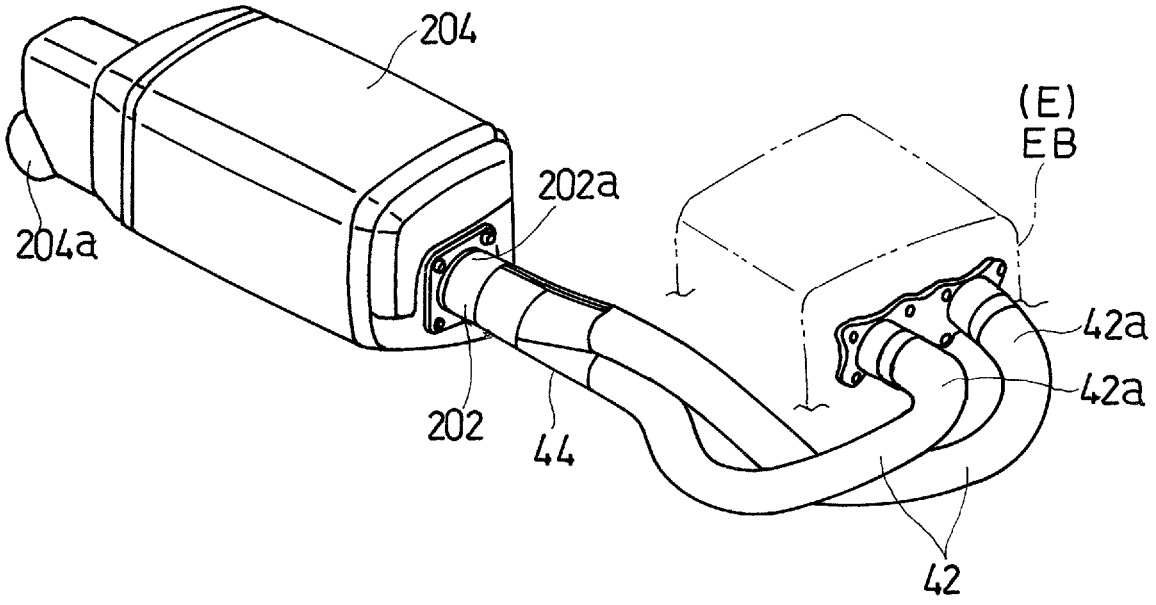
FIG. 16 is a perspective view showing the exhaust device with an exhaust covering removed.

FIG. 14 illustrates a side view showing the utility vehicle equipped with the exhaust device 200 for the engine, which device 200 is designed in accordance with a second preferred embodiment of the present invention. FIG. 15 illustrates a perspective view of the exhaust device 200 according to the second preferred embodiment. FIG. 16 is a perspective view showing a condition in which the exhaust covering 210 is removed from the exhaust device 200. Component parts employed in the practice of the second embodiment, which are similar to those employed in the practice of the previously described first embodiment, are designated by like reference numerals and, therefore, the detailed description thereof is not reiterated.

As shown in FIG. 14, the exhaust device 200 extends from the front surface of the engine main body EB in a direction rearwardly of the engine E by way of one lateral side (lateral right side). Specifically, as shown in FIG. 16, the exhaust device 200 includes two exhaust pipes 42 and 42 extending from the front surface of the engine main body EB in a direction rearwardly thereof by way of one lateral side (lateral right side), a single collecting tube 44 collecting the two exhaust pipes 42 and 42 together, an exhaust conduit 202 extending from the collecting tube 44 in a direction rearwardly of the engine E, and a muffler 204 fluid connected with a downstream end of the exhaust conduit 202.

The muffler 204 employed in the practice of the second embodiment now under discussion, is of a rectangular parallelepiped shape that is elongated in the forward and rearward direction of the vehicle and is disposed above the rear wheels 4, shown in FIG. 14, at a location leaning to one lateral side (lateral right side) of the vehicle body. The exhaust conduit 202 is fluid connected with a front end of the muffler 204, and an exit tube 204*a* is fluid connected with a rear end. The exhaust gases G, which have been silenced, are discharged to the outside through the exit tube 204*a*. Accordingly, as shown in FIG. 16, the exhaust conduit 202 employed in the practice of the second embodiment now under discussion has a length in the forward and rearward direction that is smaller than that of the exhaust conduit 46 employed in the practice of the previously described first embodiment. The collecting tube 44 and the exhaust conduit 202 may be formed integrally with each other.

In the practice of the second embodiment now under discussion, as shown in FIG. 15, the exhaust device 200 includes a front covering 206 for covering the exhaust pipes 42 and 42 and a rear covering 208 for covering the collecting tube 44 and the exhaust conduit 202, the front covering 206 and the rear covering 208 being formed integrally with each other. In other words, the exhaust device 200 in the second embodiment makes use of an exhaust covering 210 in which the front covering 206 and the rear covering 208 are formed integrally with each other. The exhaust covering 210 employed in the second embodiment covers the exhaust pipes 42 and 42, the collecting tube 44 and the exhaust conduit 202 from entire periphery.

The exhaust covering 210 includes a first exhaust covering piece 212 and a second exhaust covering piece 214 which are so divided in a vertical direction. The first and second exhaust covering pieces 212 and 214 are connected together by means of a plurality of the bolts 69, with the exhaust pipe 42, the collecting tube 44 and the exhaust conduit 202 sandwiched between the first and second exhaust covering pieces 212 and 214. Each of the first and second exhaust covering pieces 212 and 214 is made of, for example, stainless steel. It is, however, to be noted that the material for each of the first and second exhaust covering pieces 212 and 214 may not be necessarily limited thereto.

A mating surface 216 between the first exhaust covering piece 212 and the second exhaust covering piece 214 forms a single plane. In the practice of the second embodiment now under discussion, as shown in FIG. 14, the mating surface 216 is a plane extending in the horizontal direction.

The exhaust covering 210 shown in FIG. 15 has its upstream end portion 210*a* connected with the exhaust pipe 42 and also has its downstream end portion 210*b* connected with the exhaust conduit 202. In other words, no intermediate portion of the exhaust covering 210 directly contact any of the exhaust pipe 42, the collecting tube 44 and the exhaust conduit 202.

More specifically, in a manner similar to that described in connection with the previously described first embodiment, in a condition in which the vicinity of the upstream end 42 of the exhaust pipe 42 is sandwiched between the upstream end portion 212*a* of the first exhaust covering piece 212 and the upstream end portion 214*a* of the second exhaust covering piece 214, the upstream end portion 212*a* of the first exhaust covering piece 212 and the upstream end portion 214*a* of the second exhaust covering piece 214 are connected together by means of the bolts 69. Also, in a condition in which the vicinity of the downstream end 202*a* of the exhaust conduit 202 is sandwiched between the downstream end portion 212*b* of the first exhaust covering piece 212 and the downstream end portion 214*b* of the second exhaust covering piece 214, the downstream end portion 212*b* of the first exhaust covering piece 212 and the downstream end portion 214*b* of the second exhaust covering piece 214 are connected together by means of the bolts 69.

The muffler covering 218 is removably fitted to the muffler 204. In the practice of the second embodiment now under discussion, the muffler covering 218 is made of stainless sheet metal and covers regions upwardly of the muffler 204 and inwardly of the muffler 204 in the vehicle widthwise direction. Thanks to the muffler covering 218, the loading platform 10 above the muffler 204 shown in FIG. 14 and the air intake chamber 34 inwardly of the muffler 204 in the vehicle widthwise direction of the muffler 204 are protected from heat emanating from the muffler 204. It is, however, to be noted that the material and the shape of the muffler covering 218 may not be necessarily limited thereto. Other structural features of the second embodiment are similar to those employed in the practice of the previously described first embodiment.

According to the second embodiment of the present invention described above, as is the case with the previously described first embodiment, with a simplified structure, the peripheral component parts can be effectively protected from heat generated from the exhaust system. Also, according to the second embodiment, the intermediate portion of the exhaust covering 210 is not held in direct contact with the exhaust pipe 42, the collecting tube 44 and the exhaust conduit 202. Accordingly, the degree of freedom of design in selection of the material for each other first and second exhaust covering piece 212 and 214 will be increased.

In addition, the mating surface 216 between the first exhaust covering piece 212 and the second exhaust covering piece 214 forms the single plane. Accordingly, manufacture and assemblage of the first and second exhaust covering piece 212 and 214 can be facilitated.

Figure 17:
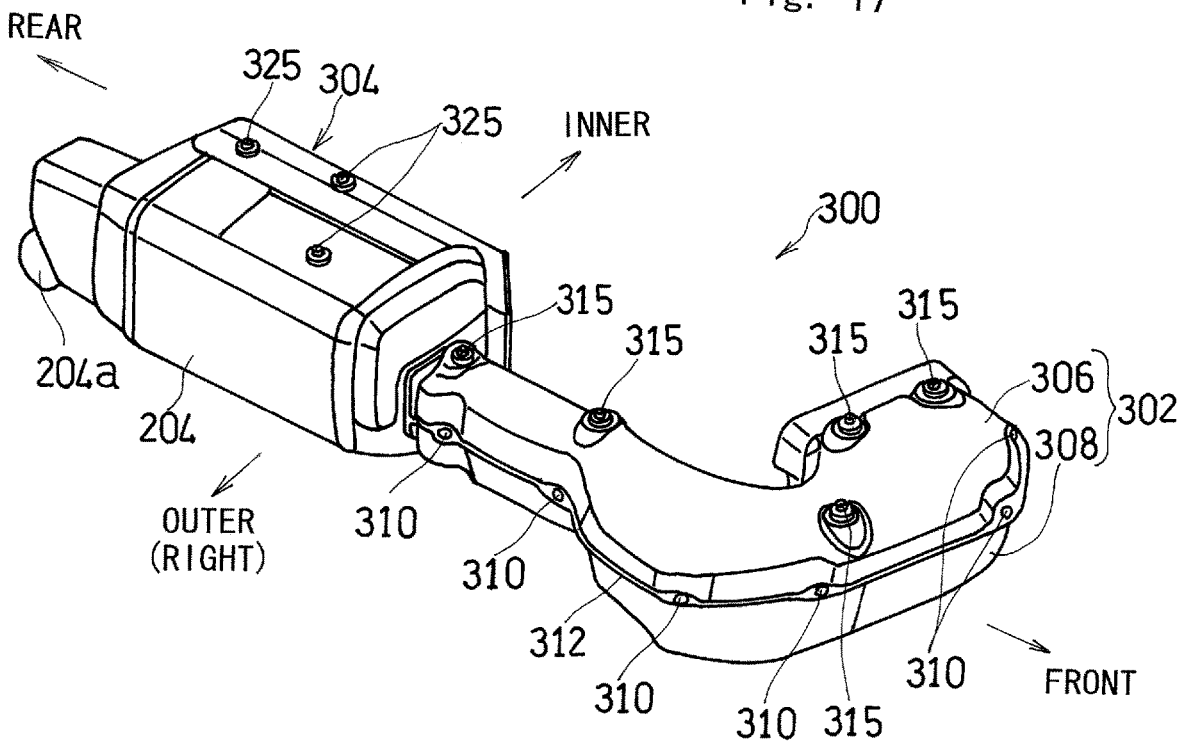
FIG. 17 is a perspective view showing the exhaust device for the engine designed according to a third preferred embodiment of the present invention.
Figure 18:
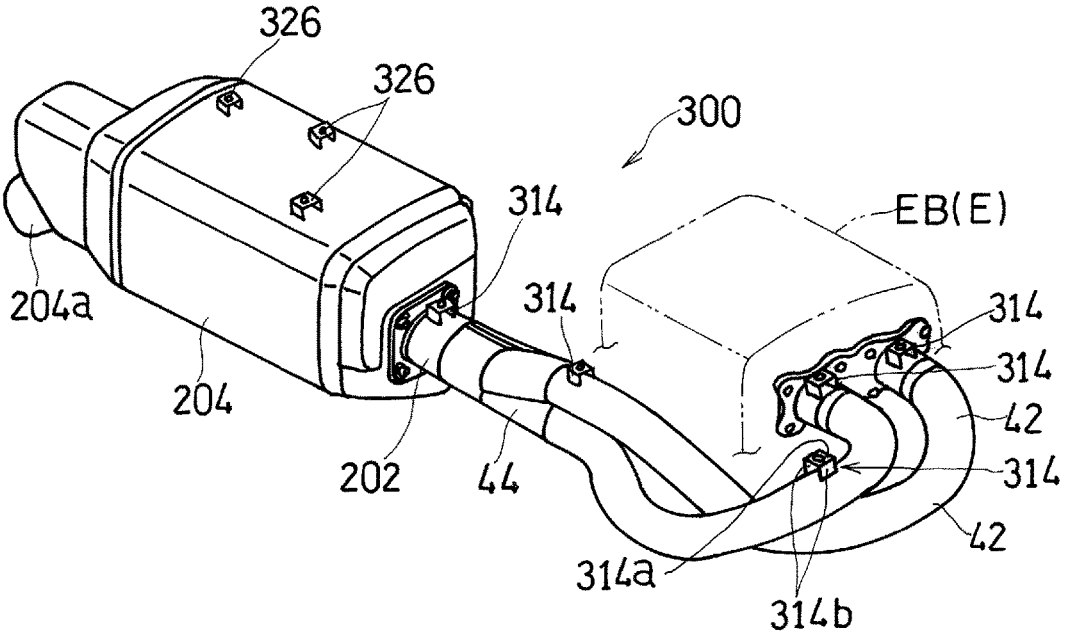
FIG. 18 is a perspective view showing the exhaust device with the exhaust covering removed.

FIG. 17 is a perspective view showing the exhaust device 300 for the engine, which is designed according to a third preferred embodiment of the present invention. FIG. 18 is a perspective view showing the exhaust device 300 with the exhaust covering 302 and the muffler covering 304 both removed. Component parts employed in the practice of the third embodiment, which are similar to those employed in the practice of the previously described second embodiment, are designated by like reference numerals and, therefore, the detailed description thereof is not reiterated. The exhaust device 300 for the engine according to this third embodiment is mounted on the automotive vehicle according to the second embodiment shown in FIG. 14.

The exhaust device 300 according to the third embodiment differs from the exhaust device 200 according to the second embodiment in respect of the fitting structure of each of the exhaust covering 302 and the muffler covering 304. In other words, as shown in FIG. 18, the exhaust device 300 includes: two exhaust pipes 42 and 42 both extending from the front surface of the engine main body EB in a direction rearwardly of the vehicle by way of one lateral side (lateral right side); a single collecting tube 44 collecting the two exhaust pipes 42 and 42 together; the exhaust conduit 202 extending from the collecting tube 44 in a direction rearwardly of the engine E; and the muffler 204 fluid connected with the downstream end of the exhaust conduit 202. The muffler 204 is disposed in, for example, the rear portion of the vehicle body structure. The engine E, the exhaust pipe 42, the collecting tube 44, the exhaust conduit 202 and the muffler 204 are disposed and shaped in a manner similar to those shown and described in connection with the second embodiment with particular reference to FIGS. 14 and 15.

As shown in FIG. 17, the exhaust device 300 also includes a single exhaust covering 302 for covering the entire periphery of the exhaust pipe 42, the collecting tube 44 and the exhaust conduit 202. This exhaust covering 302 includes a first exhaust covering piece 306 on an upper side and a second exhaust covering piece 308 on a lower side, which are so divided into those two components in a vertical direction, respectively. The first exhaust covering piece 306 and the second exhaust covering piece 308 are each made of, for example, stainless metal sheet. It is, however, to be noted that the material for each of the first and second exhaust covering pieces 306 and 308 may not be necessarily limited to that.

The first exhaust covering piece 306 and the second exhaust covering pieces 308 are removably connected with each other by means of a plurality of bolts 310. Each of the bolts 310 is inserted and fastened from above. Thus, the exhaust covering 302 represents a "two-cup shaped" structure in which two divided rectangular shaped components are connected together to define a hollow shell, with a mating surface 312 therebetween representing a single plane. In the practice of the third embodiment, the mating surface 312 is constituted by a plane parallel to the horizontal plane.

The exhaust device 300 furthermore includes a muffler covering 304 for covering the muffler 204. The muffler covering 304 is formed by folding a stainless metal sheet. It is, however, to be noted that the material and the method of making the muffler covering 304 may not be necessarily limited to that described above. The muffler covering 304 employed in the practice of the third embodiment covers regions above and inwardly of the vehicle widthwise direction of the muffler 204.

In the exhaust device 300 employed in the practice of the third embodiment now under discussion, as shown in FIG. 18, an exhaust covering bracket 314 is fitted to an upper surfaces of the exhaust conduit 202 and the exhaust pipe 42. The exhaust covering bracket 314 is employed two in number on each of the two exhaust pipes 42 and 42 and one in number on the exhaust conduit 202, totaling five exhaust covering brackets 314 employed. It is, however, to be noted that the number and place of installation of the exhaust covering bracket 314 may not be necessarily limited to that described and shown. In the practice of the third embodiment, the five exhaust covering brackets 314 are all similar in shape.

The exhaust covering bracket 314 is formed by folding a stainless metal sheet so as to represent a U-shaped configuration. Specifically, the exhaust covering bracket 314 includes a rectangular main portion 314*a* having a fitting surface that is oriented upwardly, and two leg portions 314*b* and 314*b* that extend downwardly of the main portion 314*a*. The main portion 314*a* and the two leg portions 314*b* and 314*b* cooperate with each other to render the exhaust covering bracket 314 to represent the U-shaped configuration.

A tip end (lower end) of each of the leg portion 314*b* is fixed to the upper surface of the exhaust pipe 42 and the exhaust conduit 202 by welding. The main portion 314*a* is formed with a threaded hole 314*c* that is oriented upwardly. In the practice of the third embodiment, the threaded hole 314*c* is in the form of a welded nut. The material and the shape of the exhaust covering bracket 314 may not be necessarily limited to those shown and described.

The first exhaust covering piece 306 shown in FIG. 17 is removably fitted to the exhaust pipe 42 and the exhaust conduit 202 through the exhaust covering bracket 314 (FIG. 18) with the use of bolts 315. Specifically, at a position of the first exhaust covering piece 306 which portion corresponds to the threaded hole 314*c*, a bolt insertion hole 316 which is oriented in the vertical direction is formed.

Figure 19:
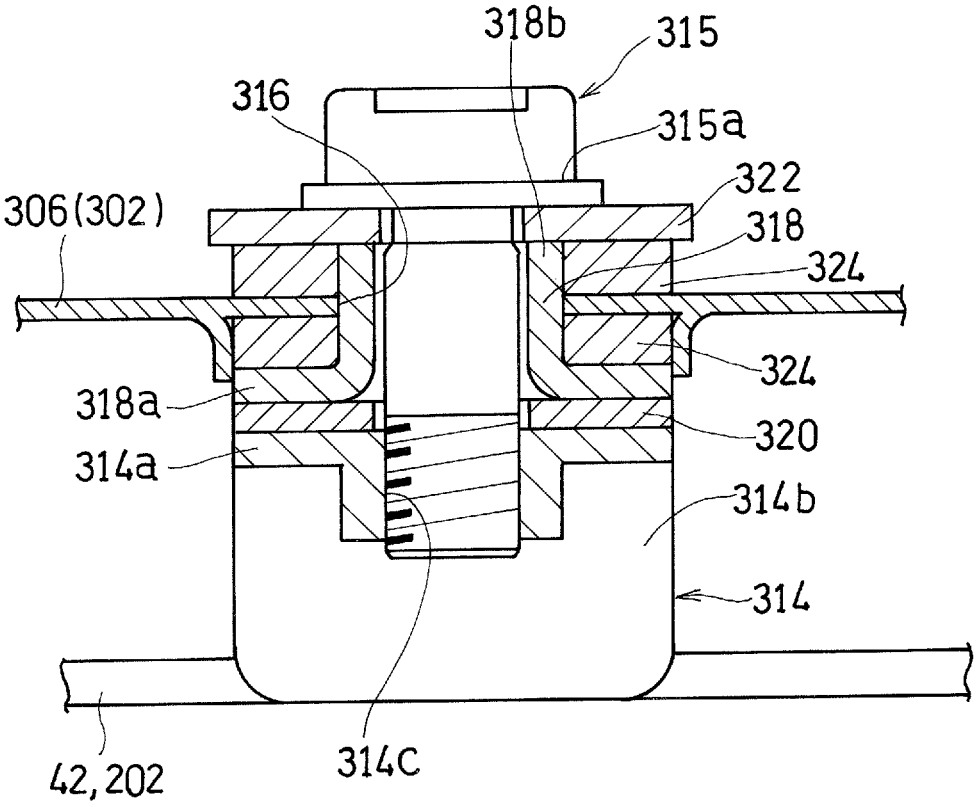
FIG. 19 is a sectional view showing a fitting structure for the exhaust covering.

As shown in FIG. 19, a flanged cylindrical collar 318 is inserted, from below, into the bolt insertion hole 316 of the first exhaust covering piece 306. The bolt 315 is inserted, from above, into a hollow portion of the collar 318, and is then flu threaded to the threaded hole 314*c* of the exhaust covering bracket 314. Thus, the first exhaust covering piece 306 is removably fitted to the exhaust pipe 42 through the exhaust cover bracket 314.

A washer 320 is interposed between an end face (lower face) of a collar portion 318*a* of the collar 318 and the main portion 314*a* of the exhaust covering bracket 314. Also, a washer 322 is interposed between a tip and (upper end) 318*b* of the collar 318 and a head portion 315*a* of the bolt 315. Furthermore, an annular damper 324 is interposed between the upper side washer 322 and the upper surface of the first exhaust covering piece 306. Yet, an annular damper 324 is interposed between a lower surface of the first exhaust covering piece 306 and the collar portion 318*a* of the collar 318.

In the third embodiment now under discussion, the damper 324 is formed by interweaving a stainless wire. Accordingly, the damper 324 employed in the practice of the third embodiment has a certain cushioning property and a repulsive force and, hence, the damper 324 has a sufficient heat resistance. When the bolt 315 is fastened into the threaded hole 314*c*, the damper 324 is compressed by the effect of a fastening force so resulting from. In other words, the first exhaust covering piece 306 is elastically supported by the exhaust pipe 42 through the damper 324. It is, however, to be noted that the material for the damper 324 may not be necessarily limited to that described and shown.

As shown in FIG. 18, a plurality of muffler brackets 326 is welded to upper and inner side surfaces of the muffler 204. Through those muffler brackets 326, the muffler covering 304 is removably fitted to the muffler 204 by means of bolts 325. The shape and the structure of the muffler bracket 326 shown in FIG. 18 are similar respectively to those of the exhaust covering bracket 314. Also, the fitting structure of the muffler covering 304 is similar to the fitting structure of the first exhaust covering piece 306 shown in FIG. 19. Accordingly, the detailed descriptions thereof are not reiterated. Other structural features of the third embodiment described above are similar to those employed in the previously described second embodiment.

According to the third embodiment hereinabove described, the peripheral components can be effectively protected from the heat generated from the exhaust system with a simplified structure, in a manner similar to any one of the first and second embodiments hereinbefore described. Also, according to the third embodiment, as shown in FIG. 19, the first exhaust covering piece 306 is fitted to the exhaust pipe 42 and the exhaust conduit 202 through the exhaust covering bracket 314, and is not held in direct contact with the exhaust pipe 42 and the exhaust conduit 202. In addition, the second exhaust covering piece 308 shown in FIG. 17 is connected with the first exhaust covering piece 306 and is not held in contact with the exhaust pipe 42 and the exhaust conduit 202. Accordingly, any possible increase of the temperature of the exhaust covering 302, which is brought about by the heat generated from the exhaust system, can be suppressed. Therefore, the degree of freedom of design in selection of the material and others for the exhaust covering 302 can be increased.

Yet, as shown in FIG. 19, the exhaust covering 302 is supported by the exhaust pipe 42 and the exhaust conduit 202 through the damper 324 that is high in heat resistance. Accordingly, any possible increase of the temperature of the exhaust covering 302, which is brought about by the heat emanating from the exhaust system, can be further suppressed.

The muffler covering 304 shown in FIG. 17 is also supported by the muffler 204 through the muffler bracket 326 (FIG. 18) in a non-contact fashion therewith. Accordingly, the degree of freedom of design in selection of the material and others for the muffler covering 304 can be increased.

In the practice of the third embodiment, the exhaust covering 302 is divided into two pieces in the vertical direction, but the direction of division of the exhaust covering 302 is not necessarily limited to the vertical direction. It is, however, to be noted that in terms of assemblability and the mounting capability, the two component division is preferred in the vertical direction.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. By way of example, although in describing the first embodiment of the present invention, the two first brackets 54 has been described and shown as fixed to the exhaust conduit 46, one of them may be provided in the collecting tube 44.

Accordingly, such changes and modifications are, unless they depart from the scope of the present invention as delivered from the claims annexed hereto, to be construed as included therein.

REFERENCE NUMERALS

8 . . . Seat
10 . . . Loading platform
12 . . . Continuously variable transmission
13*b* . . . Exhaust duct
15 . . . Battery (Electric component)
34 . . . Air intake chamber
40, 200, 300 . . . Exhaust device
42 . . . Exhaust pipe
44 . . . Collecting tube
46, 202 . . . Exhaust conduit
48, 204 . . . Muffler
54 . . . First bracket
62 . . . Welded nut
64, 206 . . . Front covering
66, 208 . . . Rear covering
68 . . . First covering piece
70 . . . Second covering piece
74 . . . Second bracket
80 . . . Clamp
84 . . . First muffler covering piece
86 . . . Second muffler covering piece
95 . . . Screw body
210, 302 . . . Exhaust covering
212, 306 . . . First exhaust covering
214, 308 . . . Second exhaust covering
216, 312 . . . Mating surface
218 . . . Muffler covering
314 . . . Exhaust covering bracket (Bracket)
E . . . Engine
EB . . . Engine main body

What is claimed is:

1. An exhaust device for a utility vehicle, which exhaust device is disposed beneath a loading platform at a site rearwardly of a seat of the utility vehicle, the exhaust device comprising:

a plurality of exhaust pipes extending from a front surface of an engine main body in a direction rearwardly of the vehicle by way of one lateral side of the engine main body;

a single collecting tube configured to collect the plurality of the exhaust pipes together;

an exhaust conduit extending from the collecting tube in a direction rearwardly of the engine;

a muffler disposed in a rear portion of a vehicle body and fluid connected with a downstream of the exhaust conduit;

a front cover covering an entire periphery of the plurality of the exhaust pipes; and a rear cover covering the collecting tube and the exhaust conduit from at least outer lateral side and above, the rear cover being draped over a bracket attached to the exhaust conduit and secured to the bracket via a clamp located around outside of the rear cover, the bracket being spaced apart from the exhaust conduit and establishing a gap between the rear cover and the collecting tube and the exhaust conduit, wherein the front cover is divided into a first cover piece and a second cover piece, the first and second cover pieces being connected together while upstream end portions of the first and second cover pieces sandwich upstream end portions of the exhaust pipes and downstream end portions of the first and second cover pieces sandwich downstream end portions of the exhaust pipes.

2. The exhaust device for the utility vehicle as claimed in claim 1, wherein the rear cover covers only regions laterally outwardly and above the collecting tube and the exhaust conduit.

3. The exhaust device for the utility vehicle as claimed in claim 1, wherein the clamp is located around the outside of the rear cover at a portion corresponding to, and aligned with, the bracket.

4. The exhaust device for the utility vehicle as claimed in claim 3, further comprising a plurality of additional brackets, a first bracket of the plurality of additional brackets disposed at a rear end portion being fixed to the rear cover.

5. The exhaust device for the utility vehicle as claimed in claim 4, wherein a portion of brackets from the plurality of additional brackets are fixed to the collecting tube or the exhaust conduit.

6. The exhaust device for the utility vehicle as claimed in claim 1, wherein the front cover and the rear cover are formed integrally, and the integrally formed exhaust cover is divided into a first exhaust cover piece and a second exhaust cover piece, the first and second exhaust cover pieces being connected together while respective upstream end portions and respective downstream end portions, of the first and second exhaust cover pieces, sandwich the exhaust pipes, the collecting tube, and the exhaust conduit.

7. The exhaust device for the utility vehicle as claimed in claim 6, wherein a mating surface between the first exhaust cover piece and the second exhaust cover piece forms a single plane.

8. The exhaust device for the utility vehicle as claimed in claim 1, further comprising a first muffler cover piece and a second muffler cover piece, which are so divided in a direction circumferentially of the muffler, so as to cover a peripheral surface of the muffler, the first and second muffler pieces being fixed to nuts, which nuts are secured to the muffler, by means of screw bodies.

9. A utility vehicle comprising:

the exhaust device as claimed in claim 1; and electric component parts including a battery, which are arranged above the exhaust pipe.

10. A utility vehicle comprising:

the exhaust device as claimed in claim 1;

a continuously variable transmission disposed on the other side surface of the engine; and an exhaust duct for the continuously variable transmission, the duct being disposed above the exhaust pipe.

11. A utility vehicle comprising:

the exhaust device as claimed in claim 1; and an air intake chamber for accumulating an intake air, the air intake chamber being disposed between the engine main body and the muffler and above the exhaust pipe.

12. An exhaust device for a utility vehicle, which exhaust device is disposed beneath a loading platform at a site rearwardly of a seat of the utility vehicle, the exhaust device comprising:

a plurality of exhaust pipes extending from a front surface of an engine main body in a direction rearwardly of the vehicle by way of one lateral side of the engine main body;

a single collecting tube configured to collect the plurality of the exhaust pipes together;

an exhaust conduit extending from the collecting tube in a direction rearwardly of the engine;

a muffler disposed in a rear portion of a vehicle body and fluid connected with a downstream end of the exhaust conduit; and a cover covering the exhaust pipes, the collecting tube and the exhaust conduit, wherein the cover is draped over a bracket attached to the exhaust pipes, the collecting tube and the exhaust conduit, and is secured to the bracket via a clamp located around an outside of the cover, and the bracket is spaced apart from the exhaust pipes, the collecting tube and the exhaust conduit, and establishes a gap between the cover and exhaust pipes, the collecting tube and the exhaust conduit.

* * * * *